US005427462A

United States Patent [19]

Jackson et al.

[11] Patent Number: 5,427,462

[45] Date of Patent: Jun. 27, 1995

[54] METHOD AND APPARATUS FOR PAPER CONTROL AND SKEW CORRECTION IN A PRINTER

[75] Inventors: Larry A. Jackson; Kieran B. Kelly, both of Vancouver; Alan Shibata, Camas, all of Wash.

[73] Assignee: Hewlett-Packard Company, Palo Alto, Calif.

[21] Appl. No.: 169,472

[22] Filed: Dec. 17, 1993

Related U.S. Application Data

[60] Continuation-in-part of Ser. No. 52,140, Apr. 23, 1993, abandoned, which is a division of Ser. No. 686,214, Apr. 16, 1991, Pat. No. 5,226,743.

[51] Int. Cl.[6] ..... B41J 11/42

[52] U.S. Cl. ..... 400/579; 400/624; 400/630

[58] Field of Search ..... 400/579, 624, 628, 629, 400/630, 636, 644; 271/226, 227, 229

[56] References Cited

U.S. PATENT DOCUMENTS

| | | | |
|---|---|---|---|
| 2,366,206 | 1/1945 | Metzner | 400/625 |
| 4,438,915 | 3/1984 | Akamatsu et al. | 400/625 X |
| 4,509,734 | 4/1985 | Rutishauser | 400/625 X |
| 4,581,618 | 4/1986 | Watanabe et al. | 400/185 X |
| 4,687,362 | 8/1987 | Rünzi | 400/630 |
| 4,721,297 | 1/1988 | Katayama | 400/625 X |
| 4,990,011 | 2/1991 | Underwood et al. | 400/636 |
| 5,062,726 | 11/1991 | Inomata et al. | 400/579 X |
| 5,226,741 | 7/1993 | Kumazaki et al. | 400/579 |

FOREIGN PATENT DOCUMENTS

| | | | |
|---|---|---|---|
| 228789 | 7/1987 | European Pat. Off. | B41J 13/28 |
| 0279635 | 8/1988 | European Pat. Off. | 400/579 |
| 310422 | 4/1989 | European Pat. Off. | B41J 11/00 |
| 312407 | 4/1989 | European Pat. Off. | B41J 11/42 |
| 139474 | 7/1985 | Japan | 400/185 |
| 0037451 | 2/1986 | Japan | 400/630 |
| 121972 | 6/1986 | Japan | 400/656 |
| 0141070 | 6/1989 | Japan | 400/579 |
| 0011363 | 1/1990 | Japan | 400/630 |
| 0293174 | 12/1991 | Japan | 400/579 |
| 0155086 | 6/1993 | Japan | 400/579 |

OTHER PUBLICATIONS

Research Disclosure, Jul. 1990, No. 315, "Skew Correction Technique"*.

IBM Technical Disclosure Bulletin, vol. 30, No. 12, May 1988, "Bill Stacker For Bill-Handling Machine"*.

*Primary Examiner*—Chris A. Bennett

[57] ABSTRACT

A method for correcting the skew between the leading edge of a sheet of paper and the nip of a roller assembly in a printing mechanism includes the steps of advancing a sheet of paper into the nip and slightly therebeyond. The rollers are then rotated in reverse, causing the paper to retract from the roller assembly, with the angle and weight of the paper maintaining the leading edge within the nip. As the rollers continue to rotate backwards, the paper jiggles or dances allowing the leading edge to settle parallel with the nip under its own weight. The paper is then readvanced through the roller assembly with its leading edge parallel to the nip. A mechanism applies a drag force to the paper when the paper is being retracted from the roller assembly to keep the leading edge of the paper in the nip.

A single motor control apparatus includes a processor-controlled drive motor, a drive roller assembly, a pick roller assembly and a gearing arrangement coupling the drive motor to the roller assemblies, for selective control of the timing, speed and rotational direction thereof to achieve the above described method.

19 Claims, 18 Drawing Sheets

Fig. 17
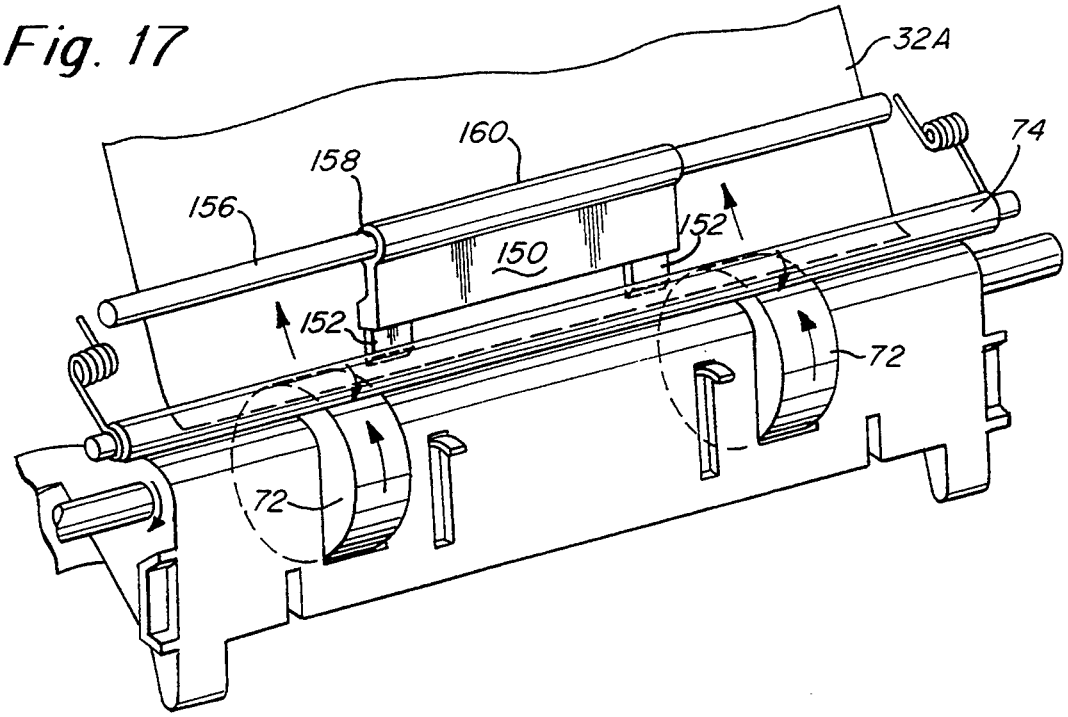
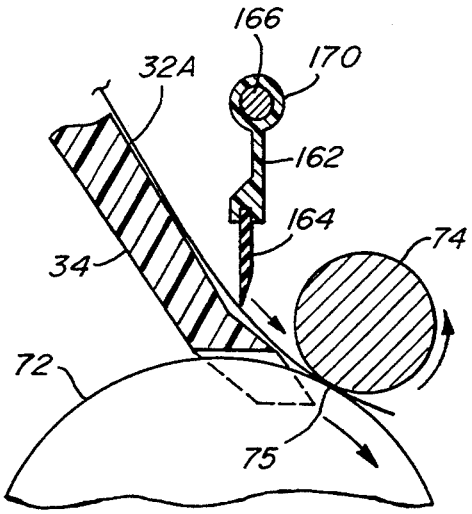
Fig. 18
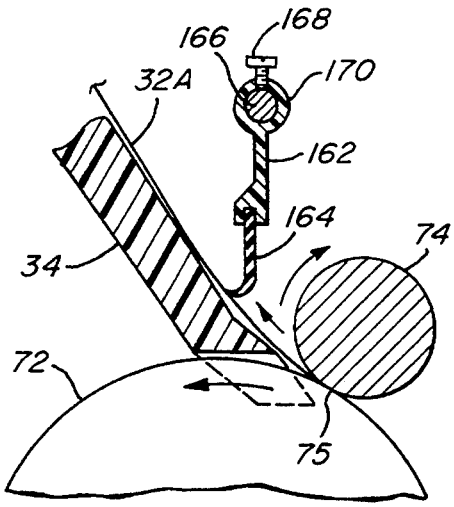
Fig. 19

Fig. 24
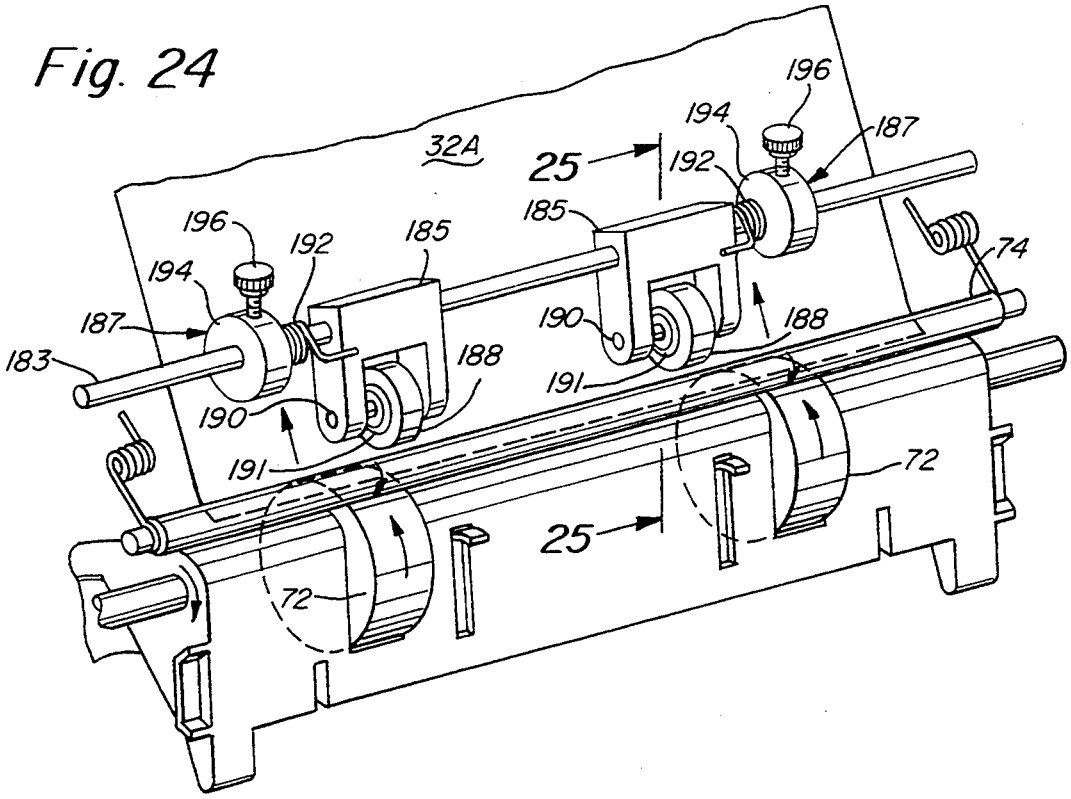
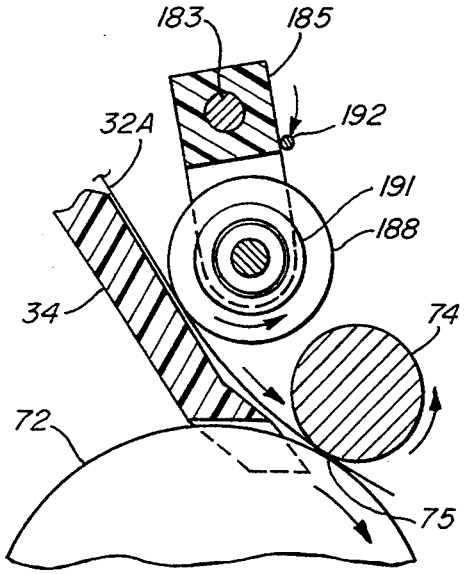
Fig. 25
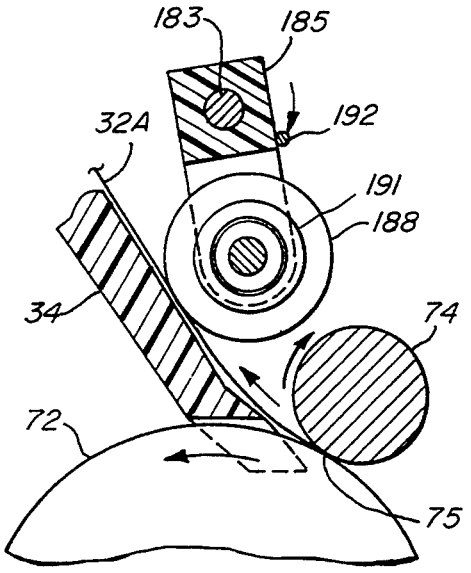
Fig. 26

METHOD AND APPARATUS FOR PAPER CONTROL AND SKEW CORRECTION IN A PRINTER

CROSS REFERENCE TO RELATED APPLICATION

This application is a continuation-in-part of application Ser. No. 08/052,140 filed on Apr. 23, 1993 now abandoned which is a division of application Ser. No. 07/686,214, filed on Apr. 16, 1991, now U.S. Pat. No. 5,226,743. The contents of this application are hereby expressly incorporated by reference.

FIELD OF THE INVENTION

This invention relates generally to printers, and more particularly to a method and apparatus for active skew correction and control of paper in a cut-sheet printer mechanism.

BACKGROUND OF THE INVENTION

In automatic cut-sheet printers, a stack of paper, cut to uniformly sized sheets, is automatically fed to a printer, typically using a roller assembly or other mechanisms. An important function of the printer feed mechanism is to control the parallelism between the top edge of the sheet of paper and the first line of print contained thereon, i.e., the amount of skew between the paper and the print. Even a small amount of skew between the paper and the print will cause the printing to appear crooked. Larger amounts of skew may cause buckling of the paper, resulting in uneven print quality or jamming of the paper within the printer. The skew is generally induced when the paper is loaded into and/or picked from a stack of paper in a supply tray. Accordingly, it is desirable to minimize the amount of skew between the paper and the printing assembly once the paper has been picked and before it is printed on.

Prior art printing devices use a variety of techniques and apparatus to minimize skew. Some printers minimize skew by forcing a sheet of paper into a pair of stalled rollers, creating a buckle in the paper and forcing the leading edge of the paper to be parallel with the roller pair. The rollers are then activated to advance the paper into the print zone. Such a technique requires some type of clutching mechanism to stall the rollers long enough to allow the paper to be fed into the nip between the rollers. Further, this technique requires accurate control of the paper while it is buckling, as the buckle must be large enough to correct the skew, yet small enough that the paper does not flip out of the nip between the stalled rollers. Other prior art printers use tapered rollers which direct the sheet of paper against a reference wall, forcing it into alignment therewith and eliminating any skew before printing. This technique requires a large, flat surface in the area of the roller assembly and is relatively slow. Still other printers have no skew correction mechanism at all, relying entirely on the accurate feeding of paper into the roller assembly.

In addition to minimizing skew, the feed mechanism of a printer must maintain accurate control of each sheet, from the time it is picked from the stack until it is ejected from the printer. The paper feed mechanisms of typical prior art printers use separate motors and gear arrangements to pick the paper from a stack, deliver the paper to the printing assembly, line feed the paper and eject the paper once printed. Such feed mechanisms often encumber the carriage drive motor and have complex timing schemes requiring triggering devices, such as solenoids. The large number of motors and other electrical components increases the cost of the printer. Further, complex feed mechanisms increase the amount of time necessary to pass a page through the printer, as well as the chances of paper jams and skew errors.

Accordingly, it is desirable to control the feed of paper through a printer using a minimum number of control devices so as to reduce the cost of the printer and increase the printer reliability and throughput.

It is, therefore, an object of the present invention to provide a paper control apparatus in a printer which has relatively few components and particularly few active components, such as motors and solenoids.

It is a further object of the present invention to provide a paper control apparatus in a printer which minimizes the possibility of catching and paper jams.

It is another object of the present invention to provide a paper control apparatus in a printer which may be driven by a single motor.

It is another object of the present invention to provide a paper control apparatus in a printer which may be implemented economically.

It is a further object of the present invention to provide a paper control apparatus in a printer which increases the throughput of the printer.

It is yet a further object of the present invention to provide a method for controlling the parallelism between the top edge of a sheet of paper and the print contained thereon.

It is a further object of the present invention to provide an active skew correction apparatus which operates quickly.

It is yet another object of the present invention to provide an active skew correction apparatus which does not require special timing or active triggering mechanisms, such as motors or solenoids.

It is yet a further object of the present invention to provide an active skew correction apparatus which may be implemented economically.

SUMMARY OF THE INVENTION

The above and other objects are achieved in accordance with the present invention which, according to a first aspect of the invention, provides a skew correction apparatus and method for controlling the parallelism between the top edge of a sheet of paper and the print contained thereon. The method of skew correction includes the steps of advancing a sheet of paper, disposed at an acute angle of approximately 60° with respect to horizontal, into the nip formed between a drive roller and a pinch roller, wherein the nip is defined as the region where the rollers are touching. The leading edge of the paper is advanced slightly beyond the nip. The rotational direction of the rollers is reversed, causing the paper to move backwardly until both sides disengage from the roller assembly. Upon disengagement, the angle and weight of the paper encourage its leading edge to settle in the nip, and as a result, to be parallel to the nip. While the rollers continue to rotate in reverse, the paper is allowed to jiggle, or "gravity dance" so that the leading edge of the paper is further encouraged to settle parallel with the nip of the roller assembly under its own weight. The rollers are stopped and again reversed, causing the paper to advance through the roller assembly, with its leading edge parallel to the nip. The paper advances a predetermined distance into the print zone before ink is deposited thereon to ensure a uniform top margin or "top-of-form" on each sheet.

The method of skew correction of the present invention is achieved with an apparatus which includes a single drive motor, and a microprocessor, coupled to the drive motor for selectively controlling the angular velocity of the drive motor. A pick roller and a drive roller assembly, including a drive roller and a pinch roller disposed adjacent to one another so as to form a nip therebetween, are coupled to the drive motor by a plurality of gears. The preprogrammed microprocessor controls the drive motor which, via the gears, selectively rotates the pick roller and drive roller assembly, causing advancement and retraction of the leading edge of a sheet of paper through the nip of the drive roller assembly to achieve the skew correction method of the present invention.

In one embodiment of the skew correction method and apparatus of this invention, a slight drag force is applied to the paper while the rotational direction of the rollers is reversed and while the paper attempts to move backwardly. This slight drag force augments the gravity force applied by the weight of the paper to retain the forward edge of the paper within the nip during and after the "gravity dance". This technique insures that there is no skew in the paper once it is fed through the roller assembly. Only a very slight amount of drag is applied, since too much drag would cause the paper to buckle, and too little drag would not keep the paper in the nip during the "gravity dance". In one example of the apparatus of this embodiment, the drag force is applied by depending fingers which form an acute angle with respect to the surface of the paper. In another example, the drag force is applied by a plurality of flexible fingers disposed at an acute angle with respect to the paper surface. In a further example, the drag force is applied by a friction roller with a one-way clutch, or by a frictionally pivoted cam.

A second, equally important aspect of the present invention is apparatus for single motor control of a sheet of paper in a printer. This apparatus reflects the preferred embodiment of the skew correction apparatus of this invention, although other types of apparatus may be used to implement the skew correction of this invention. This apparatus comprises a roller assembly having a drive roller and a pinch roller disposed parallel with and adjacent to one another so as to form a nip therebetween; means for supplying a sheet of paper to the roller assembly; a platen; a printing assembly for depositing ink on the sheet of paper; means for receiving the sheet of paper from the platen and the printing assembly; a drive motor; and means for coupling the drive motor to the drive roller assembly, the platen, and the supply means, and for controlled movement of the sheet of paper from the supply means through the printing assembly to the receiving means. In one embodiment, the control means comprises a programmable digital processor and the coupling means comprises a plurality of gears, rotatably intercoupled, for coupling the drive motor with the roller assembly, the platen and the supply means. In this manner, a single drive motor, through a plurality of gears and cams, controls the timing, speed and rotational direction of the roller assemblies and platen, from the initial feed of the paper through the printing process.

BRIEF DESCRIPTION OF THE DRAWINGS

The objects, advantages and features of this invention will be more clearly appreciated from the following detailed description taken in conjunction with the accompanying drawings in which:

FIG. 17 is an alternative embodiment of the drag force applying mechanism of FIG. 15;

FIGS. 18 and 19 are cross-sectional side views showing another alternative embodiment of the drag force applying mechanism of FIG. 15;

FIG. 24 is a partial, perspective view of a printer mechanism showing yet another further embodiment of the drag force applying mechanism of this invention;

FIG. 25 is a cross-sectional side view taken along the line 25—25 of FIG. 24; and FIG. 26 is a cross-sectional side view of the printer of FIG. 24 showing operation of the drag force applying mechanism.

DETAILED DESCRIPTION OF THE PREFERRED EMBODIMENTS

Figure 1:
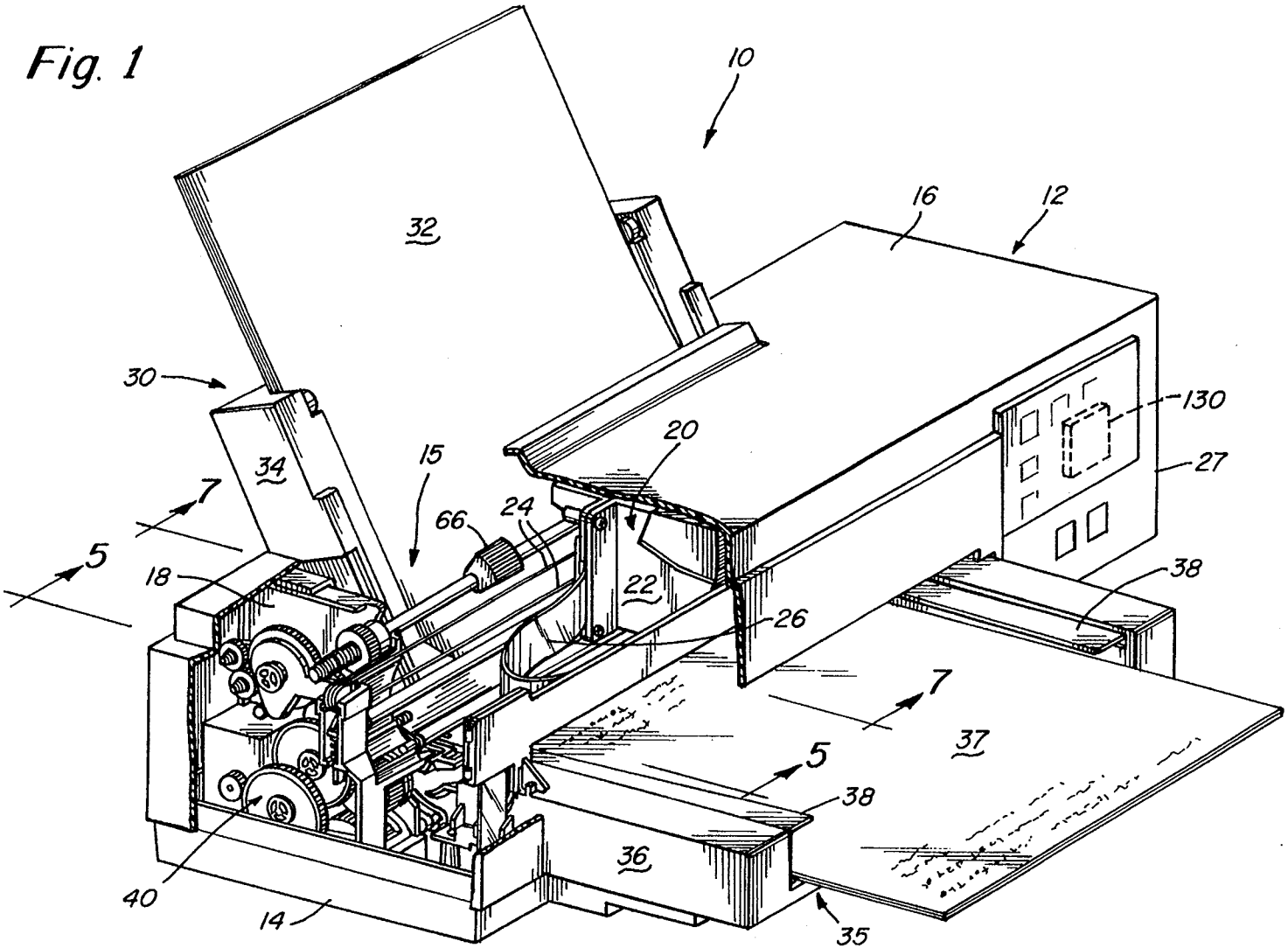
FIG. 1 is a perspective view of a printer containing the paper control and skew correction apparatus of the present invention.

With reference now to the drawings, and more particularly to FIG. 1 thereof, a typical printer will be described with which the paper control and skew correction apparatus of this invention may be used. Printer 10, as shown in the drawings, is of the ink-jet type in which printing is done in a substantially horizontal plane. However, it is to be understood that paper control and skew correction apparatus of this invention is shown used in conjunction with this type of printer for purposes of illustration only. The apparatus of this invention may be used with other types of printers including impact printers, and the like, as well as printers in which the printing is not done in a substantially horizontal plane and which have different configurations.

As shown in FIG. 1, printer 10 includes a housing assembly 12 which contains paper control apparatus 15 and printing assembly 20. Housing assembly 12 is comprised of a substantially rectangular base 14 having a pair of frame walls 18 projecting upwardly therefrom. A support 13 (shown in FIG. 7), having a substantially L-shaped cross-sectional profile and a lip, extends between frame walls 18 and is disposed at an angle for supporting supply assembly 30 as explained hereinafter. The components of paper control apparatus 15 and printing assembly 20 are secured to base 14, walls 18 and support 13, as explained hereinafter. A cover 16 is removably mounted to base 14, to allow access to the interior thereof. A supply tray 34 containing a paper supply 32, or other print medium, is removably mounted within an aperture on top of cover 16 for supplying paper to printer 10. A receiving tray 36 which is secured to base 14, projects outwardly from an aperture in front of cover 16, for receiving printed sheets of paper. Each sheet of paper is moved by paper control apparatus 15 through a printing zone where print assembly 20 deposits ink on it as it advances toward receiving tray 36.

Figure 4:
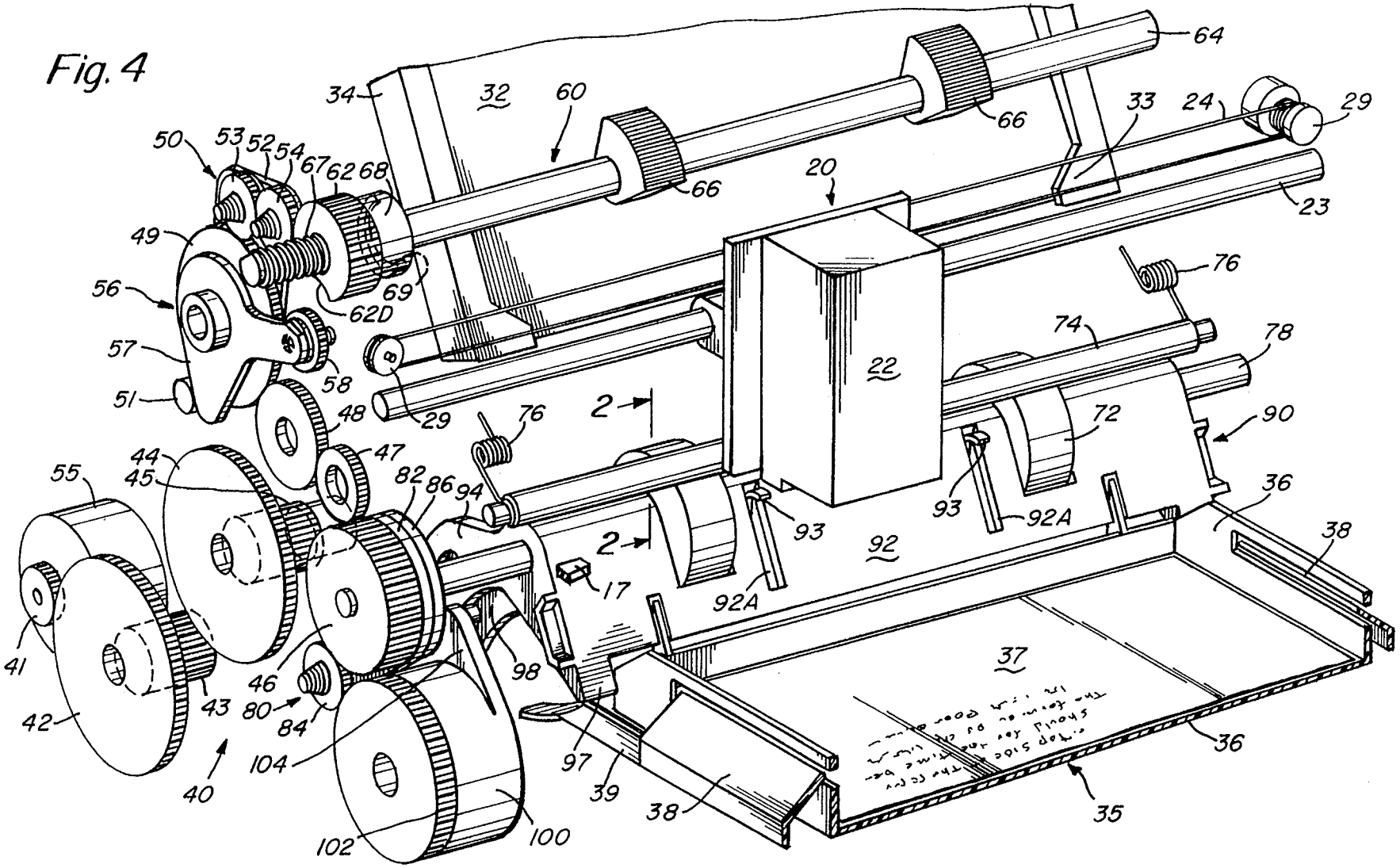
FIG. 4 is an exploded, perspective view of the paper control and skew correction apparatus of FIG. 1.
Figure 7:
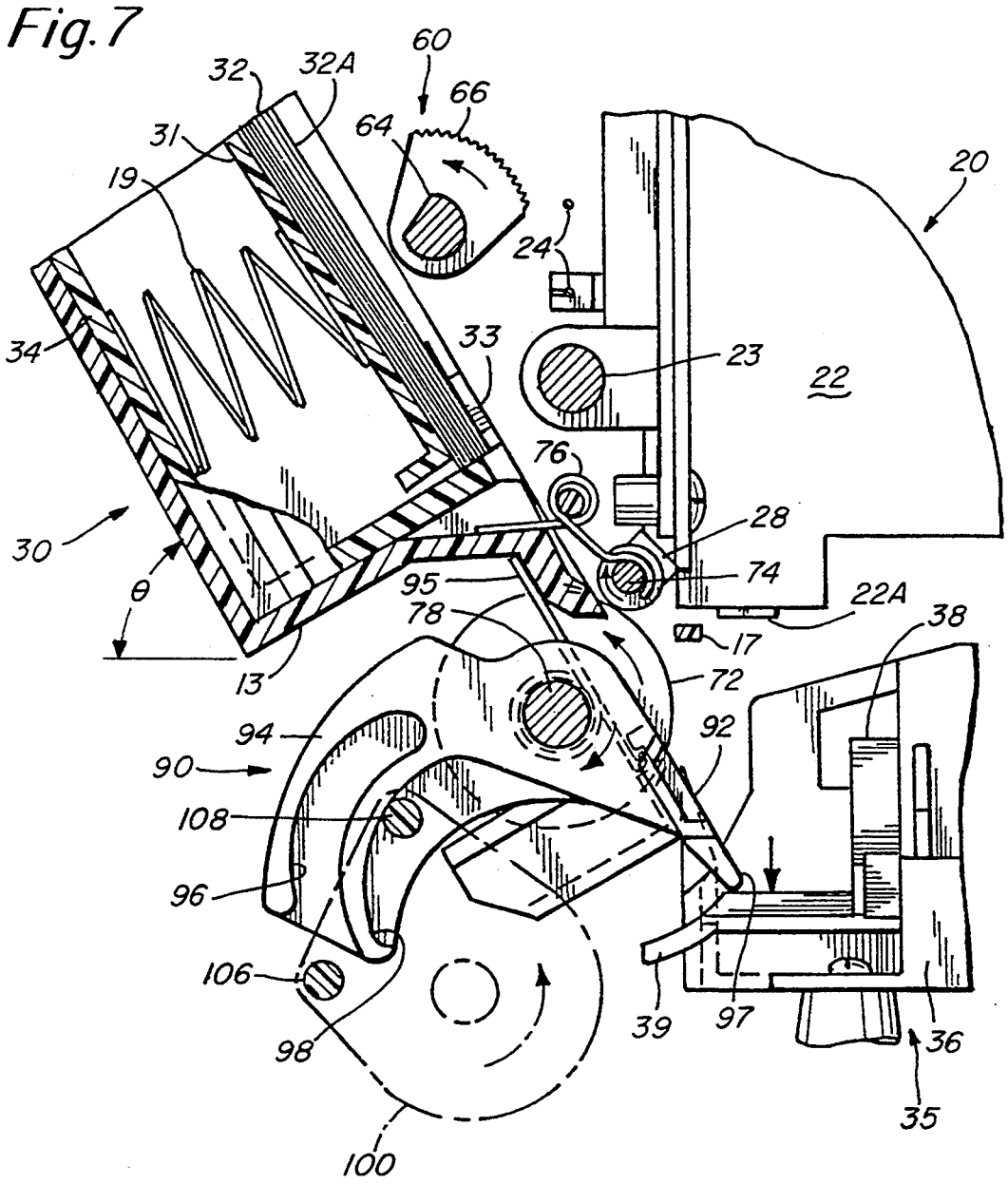
FIG. 7 is a partial, side cut-away view of the paper control and skew correction apparatus of FIG. 1 as seen along line 7—7.

Referring to FIGS. 1, 4 and 7, print assembly 20 includes print head carriage 22 which travels back and forth on carriage rod 23 through the printing zone. Print head carriage 22 moves bidirectionally by means of a drive wire 24 coupled to a carriage motor by drive wire spools 29, in a manner well known to those skilled in the art. The bottom of the printhead carriage includes a low friction pad 28 which rests on pinch roller 74 allowing printhead carriage 22 to slide easily thereover. Print head carriage 22 includes one or more print cartridges (not shown) having print heads 22A contained at the bottom thereof. The print head cartridges are connected by a flexible electrical interconnect strip 26 to a microprocessor 130, shown in phantom in FIG. 1, which also controls the carriage motor. A control panel 27 is electrically coupled with the microprocessor 130 for selection of various options relating to the operation of print assembly 20. Such control operations, provided by presently available microprocessors, are well known in the prior art. The structure and operation of print assembly 20 forms no part of this invention, and accordingly will not be described in further detail hereinafter. Further, although microprocessor 130 is shown in the proximity of control panel 27 in FIG. 1, it will be obvious to those reasonably skilled in the art that microprocessor 130 may be positioned at other locations within housing 12, provided that the necessary electrical connections may be made to the other elements of printer 10.

Figure 2:
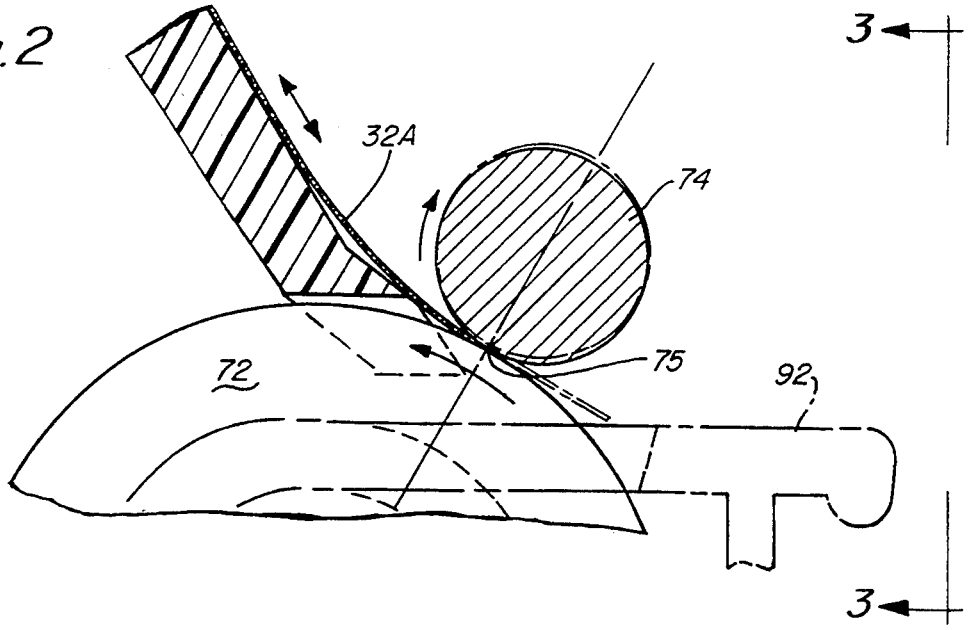
FIG. 2 is an enlarged, partial side view of the paper control and skew correction apparatus as seen along line 2—2 of FIG. 4.
Figure 3:
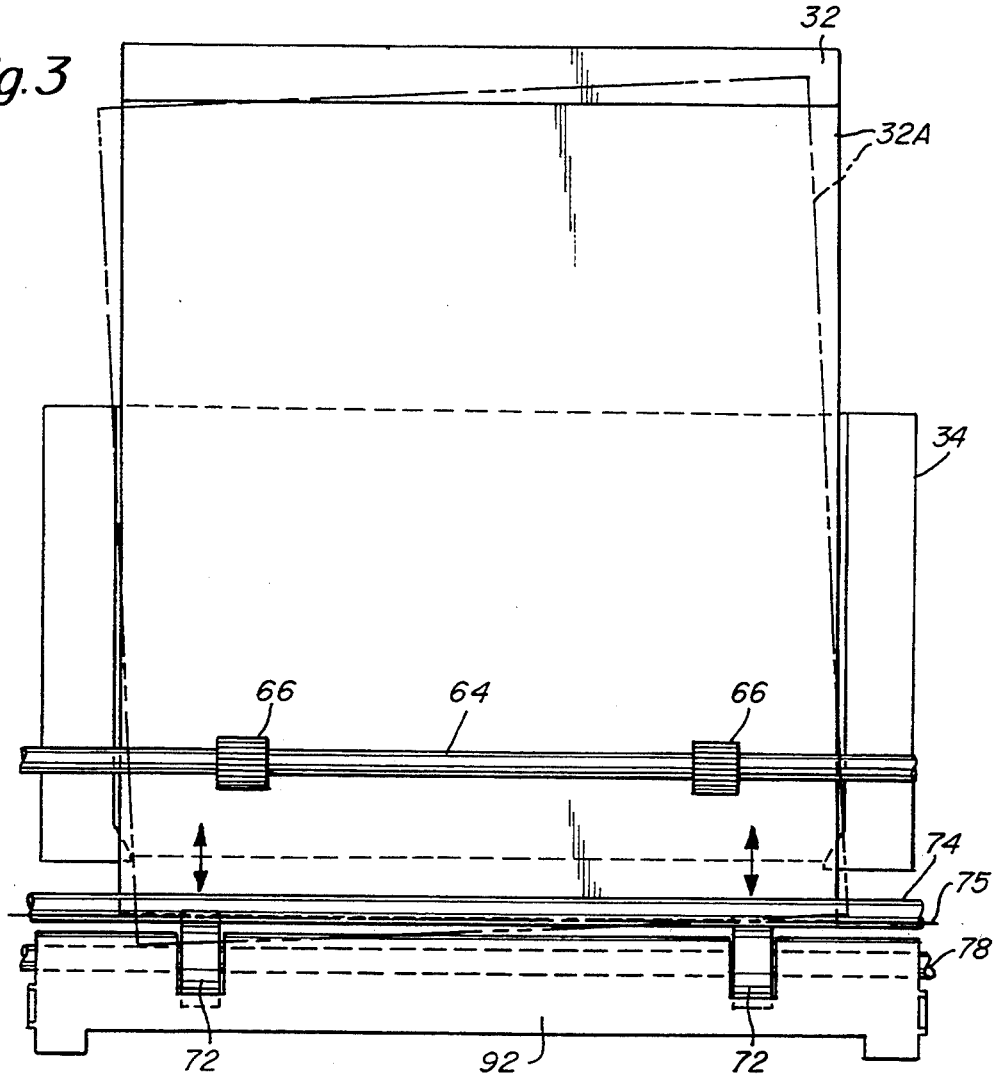
FIG. 3 is a partial front view of the paper control and skew correction apparatus of FIG. 2, as seen along line 3—3.

Referring to FIGS. 2 and 3, a top sheet of paper 32A from paper supply 32 is picked by pick rollers 66 and advanced to the drive rollers. 72 which advance the paper into the printing zone of printer 10 by a roller assembly 70 which partially comprises a pair of annular drive rollers 72, mounted about a drive roller axle 78, and a pinch roller 74 in frictional, rotational engagement with drive rollers 72. As drive roller axle 78 rotates drive rollers 72 in one direction, pinch roller 74 is rotated in a counter-angular direction. A nip 75, indicated by lines in FIGS. 2 and 3, is formed between the drive roller 72 and pinch roller 74 where the rollers make frictional contact. The combined rotational motion of drive rollers 72 and pinch roller 74 facilitates advancing or retracting sheet 32A through nip 75, depending on the directions of rotation of the roller pair, as explained hereinafter.

According to a first aspect of the present invention, an active skew correction apparatus and method for controlling the parallelism between the top edge of a sheet of paper 32A and the print contained thereon are described as follows. Generally, the method of skew correction of the present invention, comprises the steps of advancing a sheet of paper, disposed at an acute angle of preferably 60° from horizontal, into nip 75 formed between a drive rollers 72 and a pinch roller 74. The leading edge of the sheet 32A is advanced slightly beyond nip 75 by the roller assembly 70. The direction of rollers 72 and 74 is then reversed, causing the sheet 32A to move backwards and disengage from both sides of the rollers 72 and 74. Pick rollers 66 do not touch sheet 32A during its backwards movement. The weight of the paper encourages its leading edge to settle within nip 75. The sheet 32A jiggles or does a "gravity dance", while rollers 72 and 74 continue to run in a reverse direction, further encouraging sheet 32A to settle into nip 75 so that its leading edge is parallel with the nip. Rollers 72 and 74 are again reversed causing sheet 32A to advance through nip 75 with its leading edge parallel to the roller pair and the horizontal printing zone. A uniform "top-of-form" location may be located on each sheet by simply advancing the leading edge a predetermined distance beyond the nip, without the need for special detection switches, as in prior art printers. For the purposes of this disclosure, the horizontal printing zone, and consequently the resulting lines of print, are assumed to be parallel with nip 75. In this manner, if the leading edge of sheet 32A is parallel with nip 75, it will also be parallel with the first and all subsequent lines of print deposited on sheet 32A. The skew correction method of the present invention is achieved with paper control apparatus 15, the operation of which will now be described with reference to FIGS. 2–14.

FIGS. 2 and 3 illustrate side and front views, respectively, of pinch roller 74 and driver roller 72 in relation to top sheet 32A during the gravity dance routine of the present invention. FIG. 2 is an enlarged cross sectional view of rollers 72 and 74 and sheet 32A seen along line 2—2 of FIG. 4. The initial position to which the leading edge of sheet 32A is advanced beyond nip 75 of rollers 72 and 74 is indicated in phantom. Drive roller 72 then rotates counterclockwise while pinch roller 74 rotates clockwise allowing sheet 32A to move backward from its initial position until it disengages from the rollers (all directions are as shown in FIG. 2). As rollers 72 and 74 continue to rotate in reverse, the leading edge of sheet 32A completely disengages from both sides of rollers 72 and 74, and jiggles or dances, settling into nip 75 due to its own weight.

As indicated in FIG. 3, a possible initial skewed position of top sheet 32A during its feed is indicated in phantom. Following the gravity dance, top sheet 32A, assumes the position indicated by the solid lines in FIG. 3, in which its leading edge is shown substantially parallel with nip 75 formed between drive roller 72 and pinch roller 74. With the leading edge of top sheet 32A now parallel with nip 75, the sheet may again be advanced through the nip and into the printing zone.

An alternative embodiment of the skew correction apparatus and method will now be described with reference to FIGS. 15–26. In the method and apparatus as described hereinabove with reference to FIGS. 1–3, the weight of sheet 32A provided the only force keeping the paper within nip 75 while rollers 72 and 74 run in a reverse direction. However, there may be instances in which the weight of the paper alone does not provide sufficient force to retain the leading edge of sheet 32A within nip 75. Under these circumstances, sheet 32A might not feed properly through nip 75, or if it does feed, it may still be skewed if one side 0f the leading edge has been backed out of nip 75 more than the other side.

To deal with this possibility, a drag force applying mechanism can be used to provide an additional force for retaining the leading edge of sheet 32A within nip 75 when rollers 72 and 74 are reversed, and when sheet 32A moves backwardly. Too much drag would be undesirable, as it would cause the paper to buckle. Too little drag would be insufficient to retain the leading edge of sheet 32A within nip 75. The drag force applying mechanism should be placed close to rollers 72 and 74 and close to nip 75 so that sheet 32A will have little opportunity to buckle. The drag force applying mechanism should let sheet 32A move, but not buckle. In a preferred embodiment, the drag force applied to the paper is about three to ten percent of the paper drive force applied by either roller 72 or roller 74. Furthermore, the drag force applying mechanism should not apply a significant drag force on sheet 32A as it is being advanced forwardly through nip 75. In a preferred embodiment, the drag force as sheet 32A is being advanced through nip 75 should be very close to zero, or less than one to two percent of the paper drive force which is provided by either roller 72 or roller 74. If this forward drag force is too high, line feed precision may suffer or, sheet 32A could stall.

Figure 15:
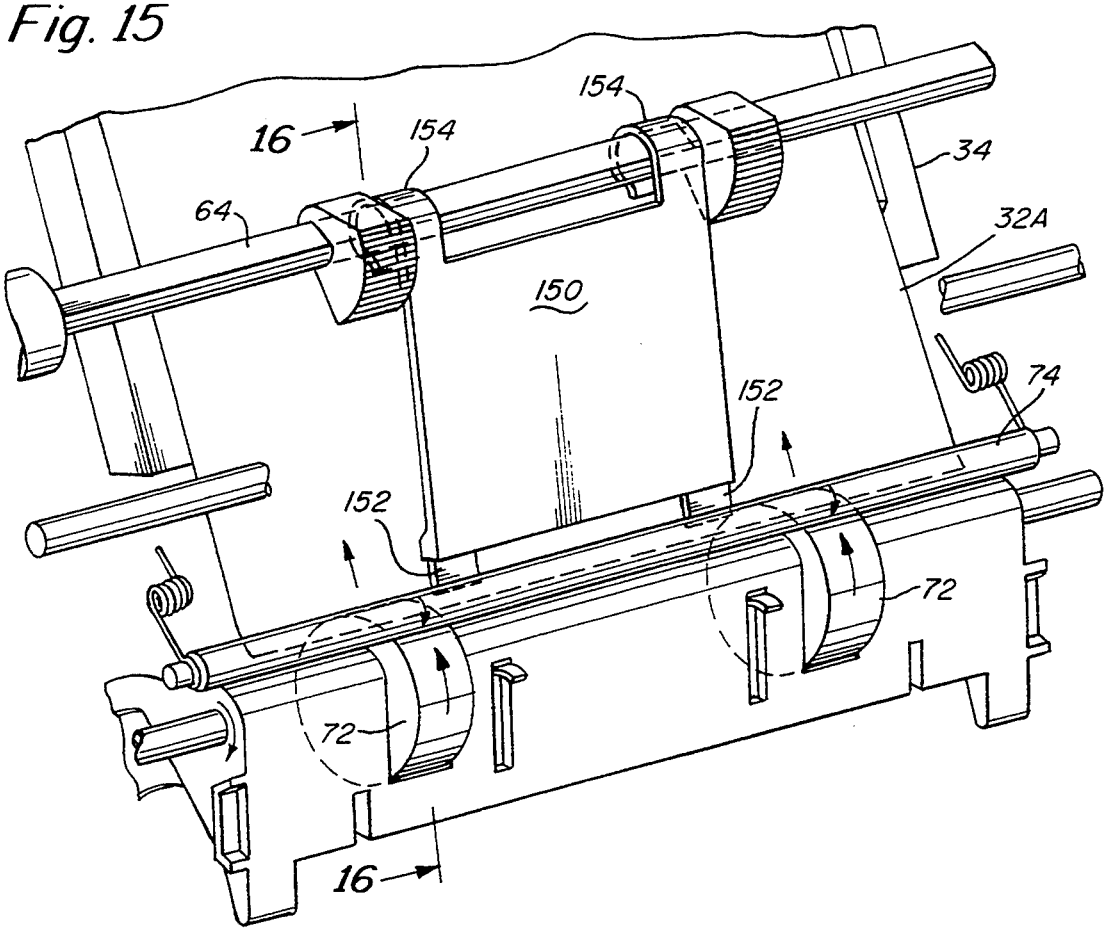
FIG. 15 is a partial, perspective view of the printer of FIG. 1 illustrating one embodiment of the drag force applying mechanism of this invention.
Figure 16:
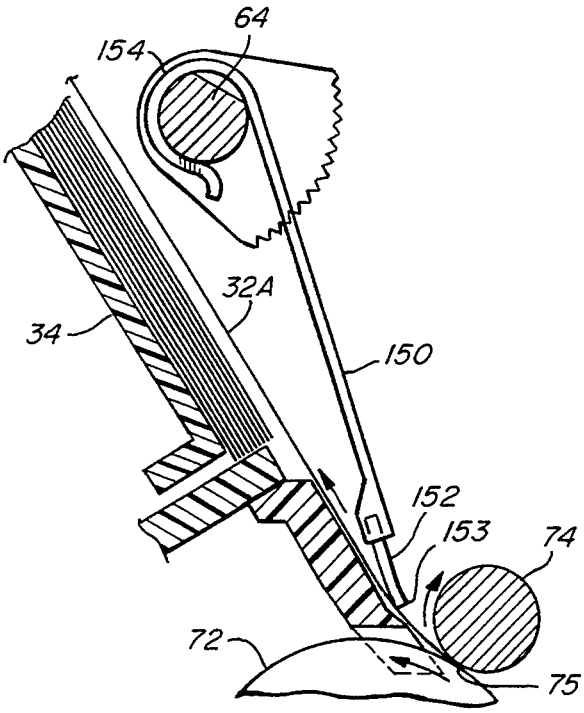
FIG. 16 is a cross-sectional side view taken along the line 16—16 of FIG. 15.

Different, acceptable examples of the method and apparatus of this embodiment will now be described with reference to FIGS. 15–26. Like numbers will be used for like parts where possible. In one example, as shown in FIGS. 15–17, the drag force applying mechanism includes a depending plate 150, and one or more flexible fingers 152 extending from plate 150, tips.153 of fingers 152 being in engagement with sheet 32A adjacent nip 75. In the example shown in FIGS. 15 and 16, there are two rubber fingers 152. Plate 150 is disposed at an acute angle with respect to sheet 32A and with respect to the vertical so that fingers 152 form an acute angle with respect to sheet 32A. The tips 153 of fingers 152, as well a sufficient surface area adjacent tips 153 rest in frictional contact with sheet 32A.

Plate 150 is shown as depending from pick shaft 64 (see FIG. 3). Since pick shaft 64 must be free to pivot, plate 150 must not be secured immovably to pick shaft 64. Pick shaft 64 must be allowed to pivot with respect to plate 150. In one embodiment, as shown in FIG. 16, plate 150 is provided with two or more preformed, resilient arcuate hooks 154 which can be snapfit over pick shaft 64 to allow easy installation and removal of plate 150, and to allow pick shaft 64 to rotate with respect thereto. In an alternative embodiment, as shown in FIG. 17, plate 150 depends from a rod 156 the ends of which are mounted to the printer frame (not shown) independently of pick shaft 64. Plate 150 can be mounted to rod 156 in any known manner, such as by the provision of a channel 158 formed in an enlarged, generally cylindrical, upper end 160, and through which rod 156 extends, as shown in FIG. 17. Even in this embodiment however, plate 150 must be free to pivot with respect to rod 156 so that the weight of plate 150 applies a drag force to sheet 32A.

In the embodiment shown in FIG. 16, as sheet 32A is advanced through nip 75, fingers 152 apply a very small drag force to sheet 32A due to the frictional interaction of fingers 152 and sheet 32A. Fingers 152 tend to flex away from sheet 32A, so that the frictional force is minimized. However, when rollers 72 and 74 are reversed, as shown in FIG. 16, a greater drag force is applied to sheet 32A, preventing it from leaving nip 75. This greater drag force is due to the angle of fingers 152 and the fact that friction causes the fingers to flex toward sheet 32A. This effect is enhanced by the position of the tips 153 of fingers 152 very close to nip 75.

The drag force applied to sheet 32A is a product of the normal force on sheet 32A applied by fingers 152 and the coefficient of friction of fingers 152. The normal force is provided by the deflection of fingers 152 toward sheet 32A and the gravity load on sheet 32A, which includes the weight of plate 150 and fingers 152 normal to sheet 32A. This load can be enhanced, if desired, by the provision of a spring or other biasing device (not shown) which causes plate 150 to bear against sheet 32A with a greater force. The frictional force applied by fingers 152 is a function of the coefficient of friction of fingers 152. The coefficient of friction is determined by the nature or composition of fingers 152. Fingers 152 should be formed of a material which has an appropriate coefficient of friction against sheet 32A. Sheet 32A could include papers of various compositions, transparencies, labels and the like. Examples of suitable materials for fingers 152 include rubber, cork and grit, as well as various types of plastics which provide the desired amount of friction, including polyvinyl chloride.

A benefit of the embodiment as shown in FIGS. 15–17 is that, as fingers 152 press on sheet 32A, sheet 32A deflects slightly into a bow. This bow assists in guiding sheet 32A into nip 75 in a direction normal to nip 75 so that the leading edge of sheet 32A is properly engaged by nip 75 without first touching one of rollers 72 or 74.

Another example of this embodiment is shown in FIGS. 18 and 19. Like numbers again are used for like parts. The drag force applying mechanism in this embodiment includes a plate 162 and one or more depending fingers 164. Plate 162 depends from a rod 166 which typically is independent of pick shaft 64. The ends of rod 166 are mounted on the machine frame (not shown). Plate 162 has a more vertical orientation than plate 150 of FIGS. 15–17. Finger 164 is tapered at its distal tip to provide a higher degree of flexibility for finger 164 than for fingers 152. The desired drag force on sheet 32A as it moves backwardly is applied by deflection of finger 164, as shown in FIG. 19, due to the frictional interaction between the tip of finger 164 and sheet 32A. When sheet 32A is moving forwardly through nip 75, very little drag force is applied by finger 164, except for that resulting from frictional interaction between the distal tip of finger 164 and sheet 32A. Since the weight of plate 162 and fingers 164 is carried almost entirely by rod 166, the small drag force on sheet 32A is caused primarily by deflection of fingers 164. Rod 166 also is mounted in a channel formed in an enlarged, cylindrical portion 170 on one end of plate 162. Preferably, plate 162 is prevented from pivoting with respect to rod 166, such as by use of a set screw 168, passing through portion 170 to rod 166 as shown in FIG. 19.

In this embodiment, finger 164 preferably is formed of a highly flexible material, so that the drag force applied by deflection thereof does not exceed the desired amount. Preferred materials include rubber, or various plastics, such as polyvinyl chloride, polyethylene or polypropylene which have a reasonably high coefficient of friction. The desired materials must have a sufficiently high coefficient of friction that deflection of finger 164 is produced by frictional interaction between finger 164 and sheet 32A during reverse movement of rollers 72 and 74. The desired coefficient of friction can be produced by roughening the surface of the tip of finger 164 in a known manner.

Figure 20:
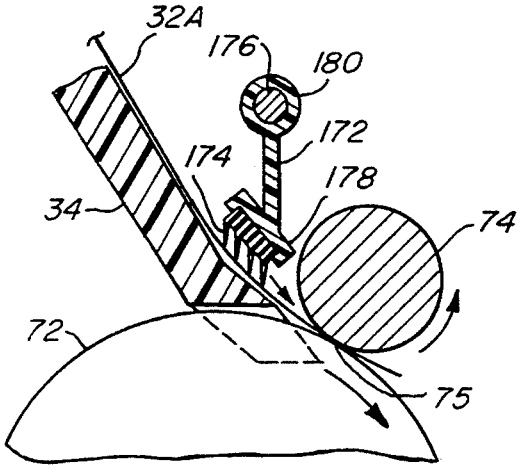
FIGS. 20 and 21 are cross-sectional side views showing yet another embodiment of the drag force applying mechanism of FIG. 15.
Figure 21:
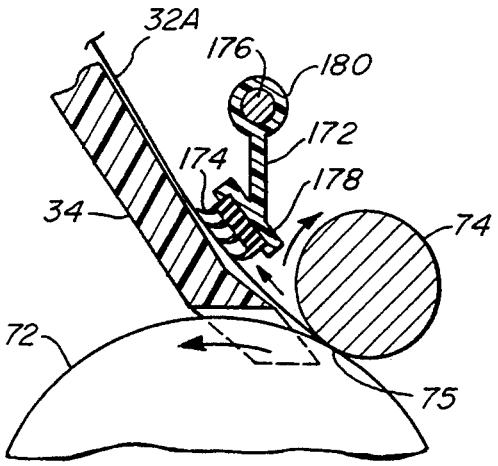

Another example of this embodiment will now be described with particular reference to FIGS. 20 and 21. The drag force applying mechanism of this example includes a depending plate 172, a rod 176 from which plate 172 depends and a support 178 disposed on the lower end of plate 172 containing a plurality of extended fingers 174. Preferably, plate 172 is fixed so that it does not pivot with respect to supporting rod 176. Each end of rod 176 is mounted on the machine frame. Rod 176 passes through a channel formed in an enlarged upper portion 180 of plate 172. Extending from support 178 are a plurality of highly flexible fingers 174 which typically are angled to point toward to nip 75 and which form an acute angle with respect to sheet 32A as it is being fed to nip 75, as shown in FIG. 20. As sheet 32A is advanced toward nip 75, the drag force applied to sheet 32A by fingers 174 is relatively small, because of the flexible nature of the fingers, and because fingers 174 form an acute angle with respect to sheet 32A in its direction of movement. As shown in FIG. 21, as the direction of movement of sheet 32A is reversed so that it is moving away from nip 75, the frictional interaction between fingers 174 and sheet 32A causes fingers 174 to be deflected away from nip 75, much like fingers 164 in FIG. 19. The combination of the frictional interaction between fingers 174 and sheet 32A, and the force required to deflect fingers 174 away from nip 75 applies a drag force on sheet 32A to retain it within nip 75. Fingers 174 typically are formed of a flexible material which has a reasonably high coefficient of friction. Suitable materials include rubber, and various types of plastic including polyvinyl chloride, polyethylene and polypropylene. The coefficient of friction between fingers 174 and sheet 32A can be increased by providing a roughened surface on fingers 174 or roughened tips on fingers 174, such as by mechanical means or by the use of a coating having greater coefficient of friction, such as grit or sand or the like.

Figure 22:
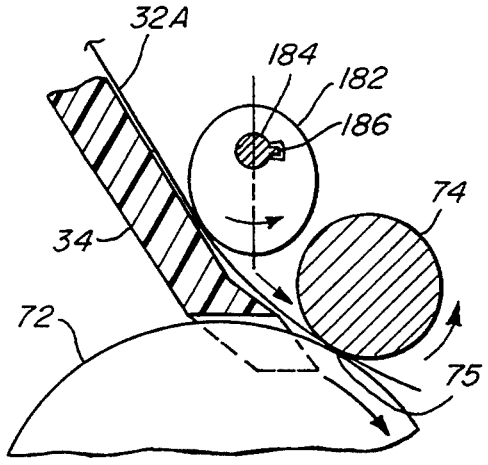
FIGS. 22 and 23 are cross-sectional side views showing yet another further embodiment of the drag force applying mechanism of FIG. 15.
Figure 23:
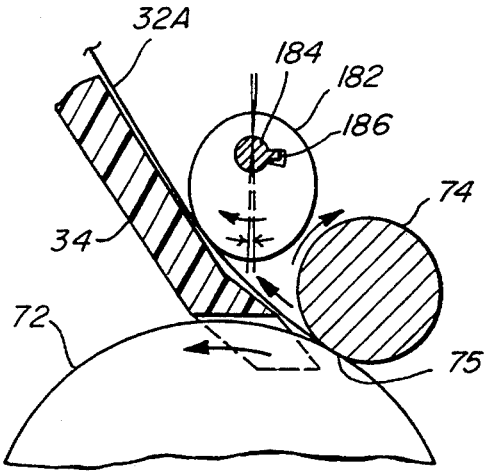

Another example of this embodiment will now be described with reference to FIGS. 22 and 23. Like numbers are used for like parts. This example includes a cam 182 mounted eccentrically about a rod 184. Each end of rod 184 is supported in the machine frame (not shown). The outer surface of cam 182 is coated with a material having a high or relatively high coefficient of friction, such as rubber, cork or grit. Cam 182 is mounted such that in its normal, undisturbed condition, it bears lightly on sheet 32A under the influence of gravity, to apply a very slight drag force thereto. As sheet 32A is advanced toward nip 75, its movement tends to push cam 182 away from supply tray 34. The only drag force applied to sheet 32A is that caused by the friction between the outer surface of cam 182 and sheet 32A. However, as the direction of movement of sheet 32A is reversed so that it moves away from nip 75, as shown in FIG. 23, the frictional interaction between the outer surface of cam 182 and sheet 32A causes cam 182 to pivot about rod 184 in a clockwise direction, as shown in FIG. 23. Sheet 32A becomes pinched between supply tray 34 and the outer surface of cam 182, applying a drag force to sheet 32A. Preferably, the angle through which cam 182 may pivot about rod 184 is limited, such as by stop 186, so that the outer surface of cam 182 approaches but does not touch the surface of tray 34. In this way, complete pinching of sheet 32A is prevented, and sheet 32A can pass between a small space between the outer surface of cam 182 and supply tray 34. The drag force is supplied by the frictional interaction between the outer surface of cam 182, the surface of supply tray 34, and the surface of sheet 32A.

Another example of this embodiment will now be described with references to FIGS. 24–26. This example includes a rod 182 supported at each end by the machine frame (not shown), two or more roller housings 184 depending from rod 182, and a mechanism 186 for biasing housings 184 toward tray 34. Each roller housing 184 includes a roller 188 centrally and rotatably mounted on an axle 190. A one-way clutch 191 is mounted onto axle 190 to prevent free rotation of roller 188 in a clockwise direction, as shown in FIG. 26 and to allow free rotation of roller 188 in a counter-clockwise direction, as shown in FIG. 25. Clutch 191 may prevent rotation entirely of roller 188 in a clockwise direction, or, in a preferred embodiment, clutch 191 provides resistance to clockwise rotation of roller 188 so that a certain force must be applied to roller 188 to produce such a clockwise rotation of roller 188. Mechanism 186 may be any apparatus for urging housing 184 toward tray 34. In the particular embodiment shown in FIG. 24, mechanism 186 includes a spring 192 coiled about rod 182. One end of spring 192 bears on housing 184, while the other end of spring 192 is mounted in collar 194. Collar 194 is secured to rod 182 by screw 196. The amount of force applied to sheet 32A by roller 188 can be adjusted by rotation of collar 194 after release of set screw 196. If collar 194 is rotated in a clockwise direction, as shown in FIG. 24, greater force is applied to housing 184 and thus to sheet 32A. If collar 194 is rotated in a counter-clockwise direction, as shown in FIG. 24, less force is applied to housing 184 and thus to sheet 32A.

The operation of this example will now be described with respect to FIGS. 25 and 26. Spring 192 urges housing 184 and thus roller 188 into contact with sheet 32A. Preferably, the amount of force applied to sheet 32A is very small, and a slight spacing exists between rollers 188 and the surface of tray 34 so that sheet 32A can be advanced toward nip 75 without being pinched by roller 188. As sheet 32A is advanced toward nip 75, roller 188 is permitted to rotate in a counter-clockwise direction, as shown in FIG. 25, permitting the free and unimpeded movement of sheet 32A. When the direction of rotation of rollers 72 and 74 is reversed, and sheet 32A is retracted away from nip 75, one-way clutch 191 prevents free rotation of roller 188 in a clockwise direction, or provides resistance to rotation of roller 188 in a clockwise direction, as shown in FIG. 26, thus applying a frictional drag force on sheet 32A as it passes between the surface of tray 34 and the outer surface of roller 188. This drag force may be increased by increasing the force applied by spring 192 to housing 184, and it may be decreased by decreasing the force applied by spring 192 to housing 184. Typically, the outer surface of roller 188 is provided with a high friction material, such as rubber, cork or grit or the like. However, other materials would also be suitable.

A preferred embodiment of the single drive motor apparatus of this invention will now be described with particular reference to FIGS. 4–15. This particular embodiment also incorporates the skew correction method and apparatus of this invention and in fact represents the preferred embodiment of the skew correction apparatus. However, it is to be understood that the skew correction method may be implemented with more conventional apparatus using more than one drive motor or for other types of printers. Furthermore, it is to be understood that the method and apparatus using a single motor for control of a sheet of paper during the feed and printing stages need not employ the skew correction method. Microprocessor 130 may be programmed to either include or omit the skew correction feature, as desired.

Paper control apparatus 15 comprises supply assembly 30, receiving assembly 35, transmission assembly 40, first arm assembly 50, second arm assembly 56, pick assembly 60, roller assembly 70, third arm assembly 80, and platen assembly 90. These assemblies interact to provide accurate control and skew correction of paper as it passes through printer 10.

As shown in FIG. 7 supply assembly 30 comprises paper supply 32, supply tray 34, retainer lips 33, and flap 31. Supply tray 34 is a substantially rectangular, three-sided structure having retention lips 33 integrally formed at the corners thereof. Paper supply 32 is disposed intermediate lips 33 and a bottom flap 31, which is pivotally attached to the top of tray 34. A coil spring 19, disposed intermediate flap 31 and tray 34, biases paper supply 32 against retaining lips 33. Supply assembly 30 is slidably mounted into a support 13 which extends between frame walls 18, so that tray 34 is preferably disposed at an acute angle $\theta$, with respect to horizontal, as shown in FIG. 7. The value of $\theta$may be between 45° and 85°, with 60° being the preferred angle of inclination.

Referring to FIG. 4, receiving assembly 35 comprises receiving tray 36, printed stack 37, wings 38, and wing cams 39. Receiving tray 36 is secured to base 14 of housing assembly 12. Tray 36 retains stack 37 of printed sheets which are lowered therein, after printing, as explained hereinafter. Receiving tray 36 is substantially rectangular and includes a pair of side walls extending upwardly therefrom. Each side wall has an elongate slot disposed near the top thereof. A pair of U-shaped wings 38, each having a cam 39 extending therefrom, is pivotally mounted, one on each side, to the bottom of receiving tray 36. Wings 38 extend through apertures in the side walls of receiving tray 36 and may be pivotally retracted therefrom, by deflection of cam wings 39 by the pivoting platen 90.

Figure 5:
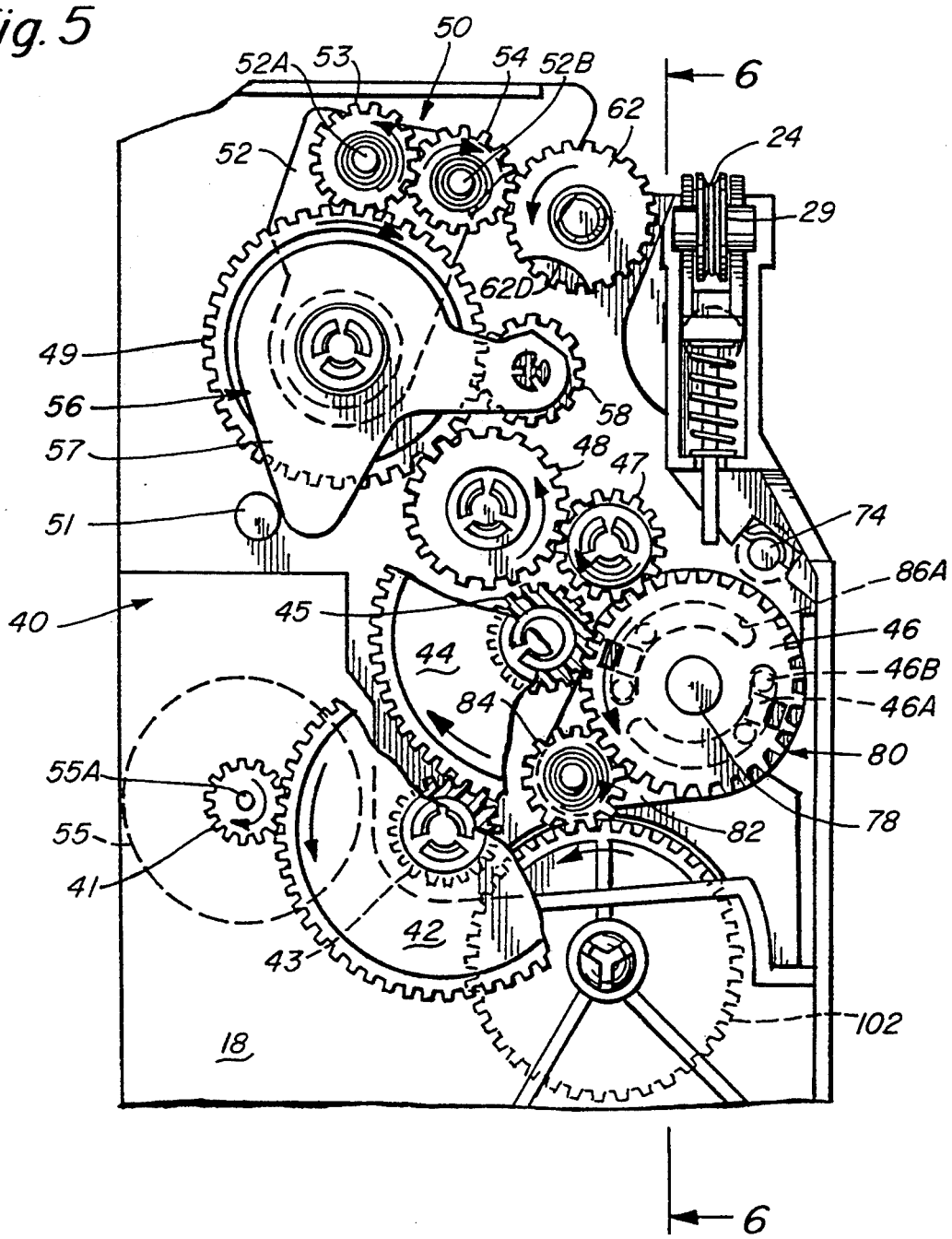
FIG. 5 is a side, partial cut-away view of the paper control and skew correction apparatus of FIG. 1 as seen along line 5—5.

Referring to FIGS. 4 and 5, transmission assembly 40 is comprised of drive motor 55 and transmission gears 41–49. Drive motor 55 may be a conventional electric motor or a stepper motor and is coupled to microprocessor 130. Microprocessor 130 is preprogrammed to control the speed and rotational direction, i.e. the angular velocity of motor 55 in a manner well known to those skilled in the art. Shaft 55A of drive motor 55 is journaled in frame 18. First transmission gear 41 is coupled to shaft 55A of motor 55, so that motor 55 and gear 41 rotate with the same angular velocity. In the preferred embodiment, gear 41 may be a spur gear having a small diameter. The teeth of gear 41 engage the teeth of gear 42 in a continuously interlocking manner so as to impart a rotational motion to gear 42 which is counter to that of gear 41.

Gear 42, in the preferred embodiment, may be a conventional spur gear having a diameter substantially larger than gear 41 so that the rotational speed of gear 42 is approximately one quarter of that of gear 41 when driven thereby. The hub of gear 42 extends perpendicularly from the interior surface thereof so as to form gear 43 which is axially aligned with gear 42. Gear 43 has a smaller diameter than gear 42, as shown in FIG. 4. Gears 42 and 43 are rotatably mounted about a cylindrical projection (not shown) extending from frame wall 18 and are retained thereabout by a conventional retainer clip. The teeth of gear 43 engage the teeth of gear 44 in an interlocking manner so as to impart a counter angular velocity thereto.

Gear 44 is similar in shape and size to gear 42 and has a gear 45, similar to gear 43, axially aligned therewith. The diameter of gear 43 is sized so that when gear 43 drives gear 44, it imparts to gear 44 a rotational speed which is approximately one quarter of that of gear 43. Gears 44 and 45 are mounted onto frame wall 18 in a manner similar to gears 42 and 43, respectively. The teeth of gear 45 engage the teeth of gear 46 in an interlocking manner so as to impart a counter angular velocity thereto.

Gear 46 is preferably a conventional spur gear which is rotatably mounted about the axle 78 of roller assembly 70 and is rotatably coupled with third arm assembly 80, as explained hereinafter. Gear 46 is sized to have approximately one half of the rotational speed of gear 45 when driven by gear 45. The teeth of gear 46 engage the teeth of gear 47 in an interlocking manner so as to impart counter angular velocity thereto.

Gear 47 is preferably a conventional spur gear and is rotatably mounted onto frame wall 18 in a manner similar to gear 42. Gear 47 is sized to have approximately twice the rotational speed of gear 46 when driven by gear 46. The teeth of gear 47 engage the teeth of gear 48 in an interlocking manner so as to impart a counter angular velocity thereto.

Gear 48 is preferably a conventional spur gear and is rotatably mounted onto frame wall 18 in a manner similar to gear 42. Gear 48 is sized to have approximately 105 times the rotational speed of gear 47 when driven gear 47. The teeth of gear 48 engage the teeth of gear 49 in an interlocking manner so as to impart rotational motion of a counter direction thereto.

Gear 49 is preferably a conventional spur gear which is disposed intermediate first arm assembly 50 and second arm assembly 56, as explained hereinafter. Gear 49 is mounted onto frame wall 18 in a manner similar to that of gear 42. Gear 49 is sized to have approximately two thirds of the angular velocity of gear 48 when driven thereby.

Figure 6:
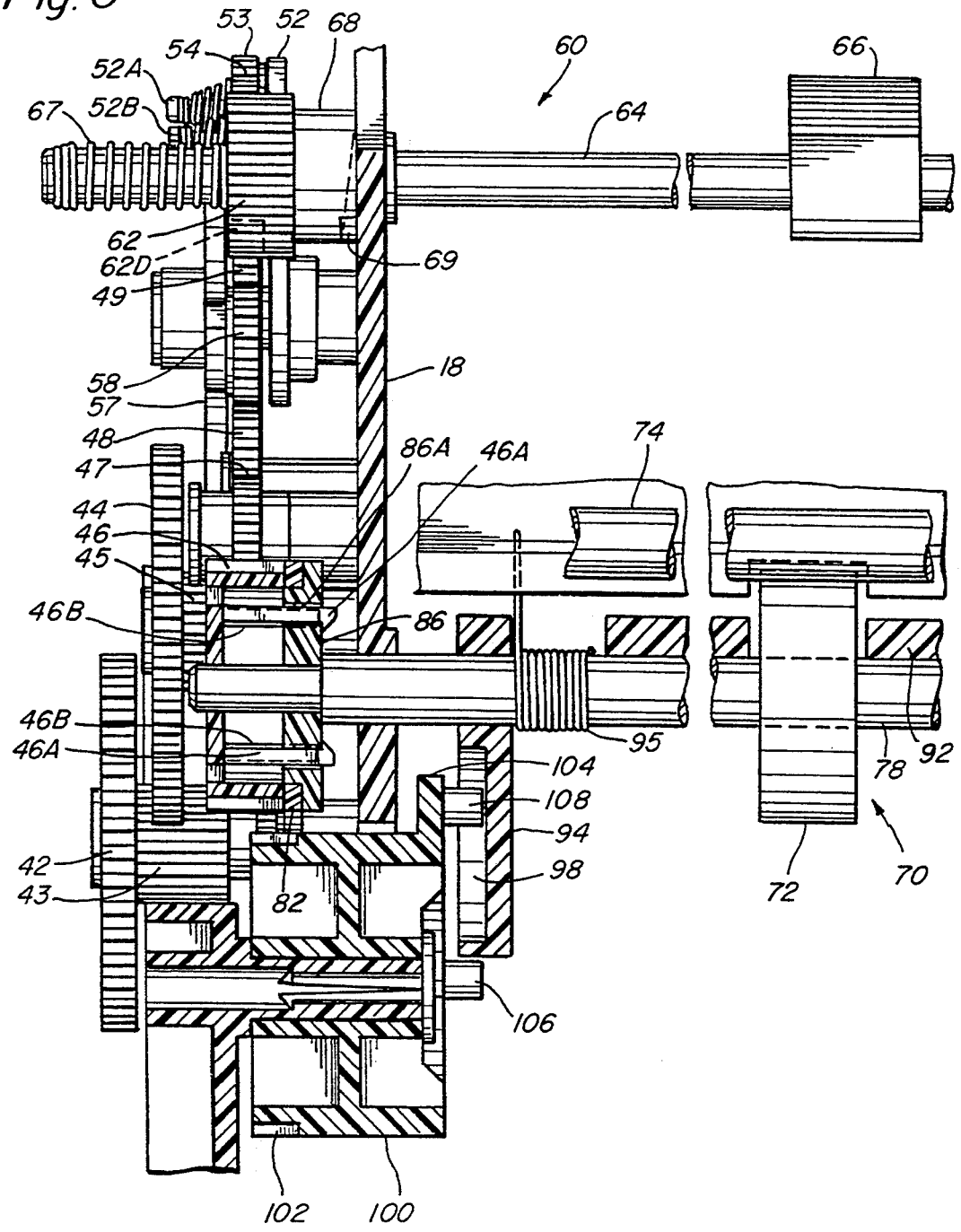
FIG. 6 is a front, cross-sectional view of the paper control and skew correction apparatus of FIG. 5, as seen along line 6—6.

Gears 41–49 are arranged as shown in FIGS. 4–6 so that gears 41, 44, 45, 47 and 49 have the same angular direction of rotation as drive motor 55, while gears 42, 43, 46 and 48 have an angular direction of rotation which is counter to that of drive motor 55. In the preferred embodiment transmission gears 41–49 are comprised of a rigid material, such as plastic, and all have teeth with uniform shape, size and pressure angles.

First arm assembly 50 comprises first arm 52, and gears 53 and 54. As indicated in FIG. 5, first arm 52 has an irregular shape (partially shown in phantom) with an aperture disposed at one end thereof for rotatable mounting to the frame wall 18 so as to be axially aligned with gear 49. At a second end of arm 52, two projections 52A–B extend perpendicularly from the exterior surface thereof. Spur gears 53 and 54 are rotatably mounted, one each, about the projections. Each of gears 52 and 53 is disposed intermediate a fiber washer (not shown) placed adjacent arm 52 and a spring secured to the respective projection, to create friction between the gear and arm 52, enabling arm 52 to pivot when necessary, as explained hereinafter.

The teeth of gear 49 engage the teeth of gear 53 for selective rotation thereof. First arm assembly 50 may pivot continuously over a range of approximately 120° from arm stop 51, which projects outward from frame wall 18, to pick gear 62 of pick assembly 60, as shown in FIG. 4. When first arm assembly 50 is disposed intermediate stop 51 or pick gear 62, the fiber washer intermediate gears 53 and 54 and arm 52 creates enough friction so that the teeth of gear 53 and gear 49 are FIG interlocked. The angular momentum imparted from gear 48 to gear 49 will not be manifested by rotation of gear 53 but by a rotation of gear 49 and first arm 52 in unison about the axis of rotation of gear 49. If arm 52 is in contact with arm stop 51 or gear 54 is engaged with pick gear 62, a rotation of gear 48 drives gear 49 which, in turn, drives gear 53 which, in turn, drives gear 54, with gears 48 and 53 rotating the same direction. Gear 54 will continue to drive pick gear 62 until the direction of gear 49 changes, as explained hereinafter.

Second arm assembly 56 is comprised of second arm 57 and gear 58, as shown in FIG. 5. Second arm 57 has an irregular L-type shape and is rotatably mounted to frame wall 18 about the axis of rotation of gear 49 on the side of gear 49 opposite first arm assembly 50. Second arm assembly 56 has a leg from which a projection (not shown) extends inwardly towards frame wall 18. Gear 58 is secured about this projection intermediate a fiber washer and spring in a manner similar to gears 53 and 54. Arm 57 selectively rotates between stop 51 and pick gear 62. While first arm assembly 50 pivots about the axis of rotation of gear 49, second arm assembly 56 also pivots about the same axis of rotation in the same direction until the leg of arm 57 encounters stop 51 or gear 58 engages pick gear 62. Upon engaging pick gear 62, gear 49 drives gear 58 which, in turn, drives gear 62 until the dish out section 62D is encountered, at which point gear 58 will continue to rotate, but with no effect on pick gear 62. The rotational motion of gears 48 and 49 causes first arm assembly 50 and second arm assembly 56 to alternately and selectively engage pick assembly 60. Since there are two gears, gears 53—54, on arm 52 and only one gear, gear 58, on arm 57 and since gears 53, 54, and 58 are driven by gear 49, the pick gear 62 will always be driven counter clockwise irregardless of the rotational direction of gear 49.

Pick assembly 60 is comprised of pick gear 62, pick shaft 64, D-shaped rollers 66, shoulder 68 and pick cam 69, as shown in FIGS. 4 and 6. Pick shaft 64 is preferably a substantially cylindrical, metal rod having a flat side, creating a D-shaped cross sectional profile. Pick shaft 64 is journaled at its end regions in frame walls 18 so as to be freely rotatable. D-shaped rollers 66 are disposed about pick shaft 64 and are positioned symmetrically about the center of top sheet 32A. D-shaped rollers 66 have a substantially D-shaped cross sectional profile and are preferably comprised of rubber or some other resilient material. The least arcuate surface of rollers 66 is corrugated to facilitate frictional engagement of a sheet of paper, as explained hereinafter. However it will be obvious to those skilled in the art that non-corrugated pick rollers may be used if their friction coefficient is sufficiently high.

Pick gear 62 is slidably mounted about the distal end of pick shaft 64, i.e. the end closest to assemblies 40 and 50. Pick gear 62 preferably is a spur gear with an arcuate-shaped dish-out section 62D along a portion of its circumference, as shown in FIG. 4. The dish-out section 62D is adapted to receive either gears 54 or 58 in a nonengaging manner. Pick gear 62 has a smooth, recessed shoulder 68 disposed on its interior surface and extending over approximately one half its circumference. The distal end of pick shaft 64 has a coiled compression spring 67 captured between an annular ridge and pick gear 62 to bias pick gear 62 against frame wall 18. Frame wall 18 includes a semi-circular inclined camming surface, pick cam 69, against which shoulder 68 is urged by spring 67. The selective deflection of shoulder 68 over pick cam 69 as pick gear 62 rotates causes axial displacement of gear 62. The axial displacement of gear 62 further causes depression of the tension spring. As pick gear 68 rotates counterclockwise, shoulder 68 disengages pick cam 69 and is urged against frame wall 18 by spring 67. As such gear 62 is disposed in a "home" position in which pick gear 62 and pick shaft 64 will not rotate further unless driven by gear 54, causing shoulder 68 to reengage pick cam 69. When gear 62 is in the "home" position gear 58 is in line with the dish-out section 62D of gear 62 and, therefore, cannot engage or turn gear 62.

Referring to FIGS. 4 and 6 roller assembly 70 is comprised of drive rollers 72, pinch roller 74, biasing springs 76, and drive roller axle 78. Drive roller axle 78 is preferably a cylindrical metal rod, having its ends rotatably journaled in frame walls 18. Drive rollers 72 are coaxially disposed about drive roller axle 78 and symmetrically positioned about the center of top sheet 32A. Drive rollers 72 have a substantially annular shape and preferably have a smooth exterior surface made of a resilient material, such as rubber, which will frictionally engage either a sheet of paper or pinch roller 74, if no paper is present.

Pinch roller 74 is preferably a cylindrical rod, having a smooth surface. Pinch roller 74 is journaled at each end to frame walls 18. A biasing spring 76 is disposed about each end of pinch roller 74 and is secured to a projection on the respective frame walls 18 to bias pinch roller 74 against drive rollers 72, creating a nip therebetween. The distal end of drive roller axle 78 extends through third arm assembly 80 and gear 46 of transmission assembly 40, as explained hereinafter.

Third arm assembly 80 comprises third arm 82, gear 84, and lost motion disk 86. Referring to FIGS. 4–6, drive roller axle 78 has a shoulder (not shown) formed at the distal end thereof. Lost motion disk 86 is a circular disk having a ridge (not shown) formed along the perimeter of the exterior surface thereof. A circular aperture (not shown) is formed at the center of lost motion disk 86 to receive the distal end of drive roller axle 78. Lost motion disk 86 is press fit about the distal end of drive roller axle 78. Lost motion disk further has two semi-circular elongated slots 86A, symmetrically disposed about the circular aperture therein. Third arm 82 has an irregular shape with an aperture disposed at one end thereof. Third arm 82 is rotatably mounted about the ridge of lost motion disk 86. A projection extends outwardly from arm 82 for receiving gear 84 which is rotatably mounted thereon. As shown in FIGS. 5 and 6, a pair of hooked arms 46A, extending perpendicularly from the interior surface of gear 46, are inserted through slots 86A, respectively, of lost motion disk 86. Each hooked arm is flanked by a pair of cylindrical pins 46B which also extends from the interior of gear 46 toward lost motion disk 86. Hooked arms 46A extend through lost motion disk 86 securing it and third arm 82 against gear 46. The pins 46B are free to rotate in either direction within the elongated slots of lost motion disk 86, depending on the angular direction of gear 46. Gear 46 engages gear 84 so as to impart a counter angular velocity thereto. Gear 84, in turn, selectively engages platen gear 102, depending on the position of arm 82, so as to impart a counter angular velocity to gear 102, as explained hereinafter.

Platen assembly 90 comprises platen 92, two-stage cam 94, first cam groove 96, second cam groove 98, platen driver 100, platen gear 102, arm 104, first cam follower 106, second cam follower 108, fingers 93, platen tabs 97 and platen spring 95. As shown in FIGS. 4, and 7, platen 92 is substantially L-shaped with a flat top surface over which each sheet passes during printing. Platen 92 is pivotally mounted about drive roller axle 78 to allow pivoting thereabout. A platen spring 95 is disposed at each end of drive roller axle 78. Springs 95 are tensionally coupled to the underside of support 13 and platen 92, for biasing platen 92 counter clockwise against stops 17 into a horizontal position. The distal end of platen 92, closest to transmission assembly 40, has an irregular shaped two-stage cam 94 integrally formed therewith. A first curved elongated slot, first cam groove 96, is formed within cam 94. A curved cavity, second cam groove 98, is further integrally formed at an edge of cam 94. Platen 92 is continuously rotatable through approximately a 90° angular displacement. A pair of tabs 97 project from the front of platen 92 which, when platen 92 is rotated to a vertical position, engage wing cams 39 of receiving assembly 35 for pivoting of wings 38, as explained hereinafter.

Platen driver 100 has a generally cylindrical shape and has platen gear 102 integrally formed along its exterior perimeter and an irregularly shaped arm 104 projecting radially from its interior perimeter. First cam follower 106 and second cam follower 108, in the form of cylindrical projections, extend perpendicularly from arm 104 and selectively engage first cam grooves 96 and second cam grooves 98, respectively. The positions of the cam followers within their respective cam grooves is dependent on the position of platen driver 100 and the angle of platen 92. FIG. 7 illustrates, in phantom, the position of platen driver 100 and platen 92, when the platen is nearing its 45° position. Platen driver 100 is pivotally mounted to frame wall 18 so as to allow rotation thereof about the axis of rotation of platen gear 102. The counter angular velocity imparted from gear 84 to gear 102 causes gear 102 and arm 104 to rotate in unison. The rotation of arm 104, in turn, causes cam followers 106 and 108 to selectively engage first cam groove 96 and second cam groove 98, respectively, causing pivoting of platen 92, as explained hereinafter.

Figure 7A:
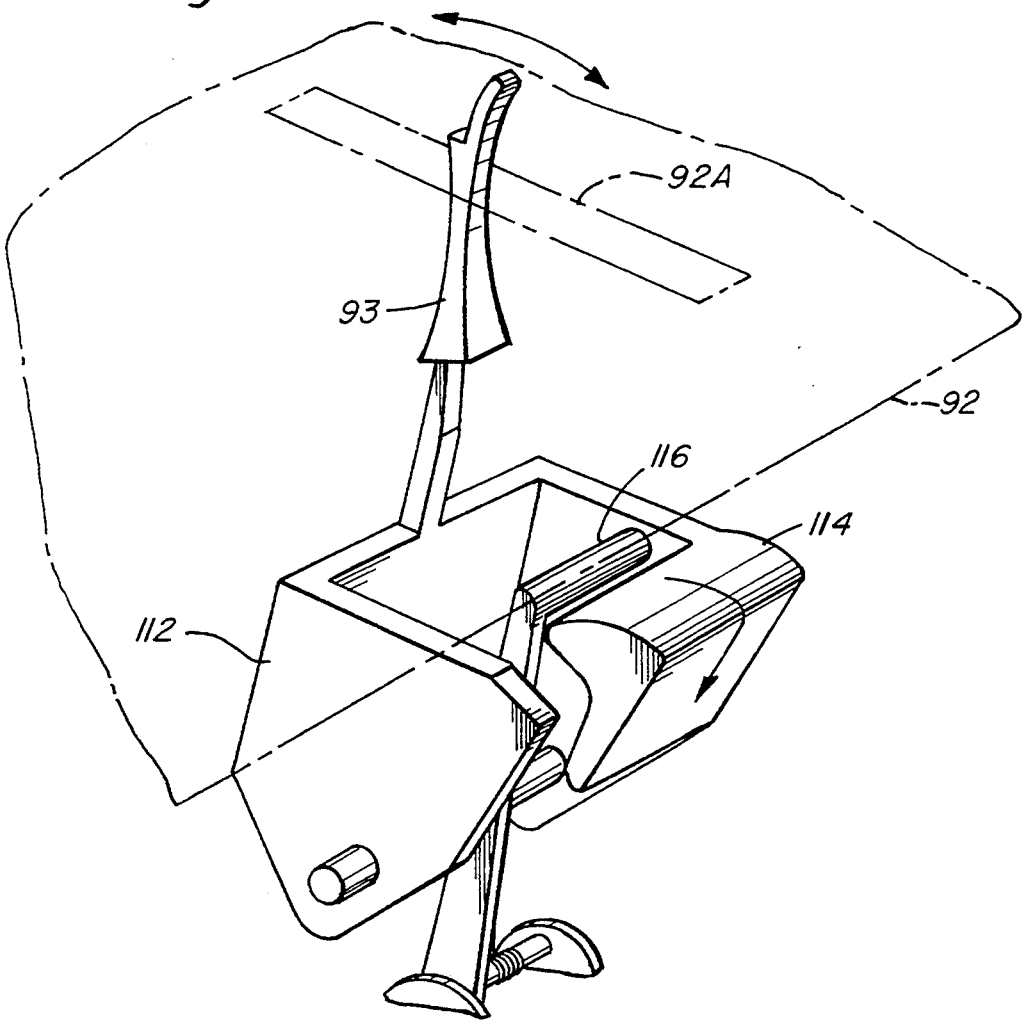
FIG. 7A is an enlarged partial perspective view of the kicker mechanism of the present invention.

Referring to FIG. 7A, one of a pair of resilient, preferably rubber, finger-like projections, kickers 93, is shown projecting through a slot 92A formed in the top surface of platen 92. Kickers 93 are attached to a kicker frame 112 which is pivotally attached to the underside of platen 92 and spring biased to pivot in a counterclockwise direction (all directions are as shown in FIG. 7A). A cam 114 is integrally formed with kicker frame 112. A cam follower 116 is pivotally attached to the base of receiving tray 36 and spring biased in a counterclockwise direction. As platen 92 pivots clockwise, cam follower 116 engages the interior surface of cam 114 causing kicker frame 112 to pivot clockwise and kicker 93 to selectively project through slot 92A. As platen 92 continues to pivot in a clockwise direction, the cam follower 116 leaves the top and exterior surfaces of cam 114, and the kicker 93 withdraws to the rear of slot 92A by a return spring located on the kicker frame 112. As platen 92 reaches its peak displacement, the lever cam 116 pivots in a clockwise direction to allow for further pivoting of platen 92 thereover. Kicker 93 assists in urging the trailing edge of top sheet 32A from platen 92 and into receiving tray 36 once the printing process is complete, as explained hereinafter. The operation of kickers 93 and particularly the interaction of platen 92 with the lever cam 116 and cam follower 114 is within the scope of understanding of those skilled in the art, and will not be explained in further detail hereinafter.

The operation of the preferred single drive motor feature of this invention which implements the skew correction method will now be described with reference to FIGS. 1–14. The terms clockwise and counterclockwise are intended to have a conventional meaning as shown when looking from the left edges of FIGS. 1–14, except FIGS. 2, 5, 6, 7. Referring to FIG. 4, printer 10 and particularly apparatus 15 is shown in a pause mode, following the printing of a sheet of paper, in which assemblies 40, 50, 56, 60, 70, 80 and 90 are in a temporarily inactive state. As indicated in FIG. 4, first arm assembly 50 is disposed in a substantially vertical position so that gear 54 nearly engages pick gear 62. Pick assembly 60 is disposed in its "home" position so that shoulder 68 is biased adjacent frame wall 18 by spring 67. In the home position, the corrugated surfaces of D-shaped rollers 66, face outwardly away from supply tray 34 and paper supply 32. Second arm assembly 56, is positioned so that arm 57 is resting against stop 51, with gear 58 disengaged from pick gear 62. As shown in FIG. 7, arm 104 of platen driver 100 is positioned so that second cam follower 108 engages second cam groove 98, causing platen 92 to pivot about drive roller axle 78. During the pause mode, platen 92 is disposed approximately 60° below horizontal, so that tabs 97 deflect the cam wings 39 of receiving assembly 35 causing wings 38 to withdraw from the apertures in the side walls of receiving tray 36. The pause mode is assumed by paper control apparatus 15 following the lowering of the most recently printed sheet into receiving tray 36 by wings 38, hence the retracted position of the wings.

Figure 8:
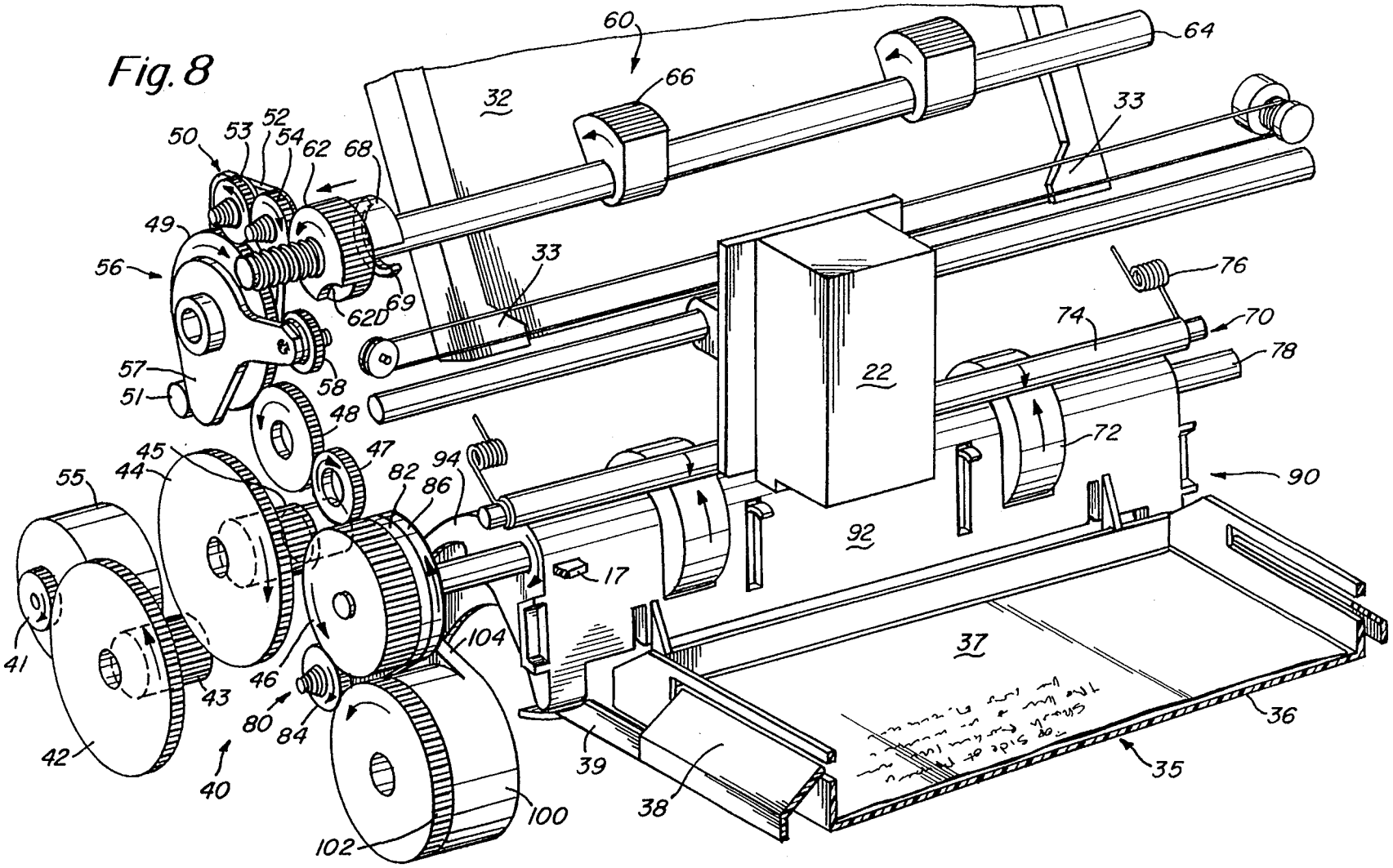
FIGS. 8–12 are sequential perspective views of FIG. 4 illustrating chronologically the positions of the components of the paper control and skew correction apparatus during the skew correction mode.

FIG. 8 illustrates the positions assumed by the various assemblies in paper control apparatus 15 during the initial phases of the pick process. The terms clockwise and counterclockwise are used with reference to FIG. 8. The feed of a top sheet 32A from paper supply 32 is initiated from the pause mode by drive motor 55 rotating under microprocessor control in the clockwise direction. The rotation of drive motor 55 causes transmission gears 44, 45, 47, and 49 to likewise rotate clockwise direction, at various lesser angular velocities, while gears 42, 43, 46 and 48 rotate in a counterclockwise direction, with various lesser angular velocities, as indicated by the arrows in FIG. 8.

Transmission gear 49 applies torque to arm 52 which rotates arm 52 clockwise until gear 54 engages pick, gear 62. Transmission gear 49 drives gear 53 of first arm assembly 50 which, in turn, drives gear 54. Gear 54 engages pick gear 62 rotating in counterclockwise direction so that shoulder 68 slides over pick cam 69 causing pick gear 62 to slide axially along pick shaft 64. Pick shaft 64 and D-shaped rollers 66 also rotate counterclockwise towards supply tray 34 and paper supply 32.

The counterclockwise rotation of gear 46 causes lost motion disk 86, drive roller axle 78 and drive roller 72 to likewise rotate in counterclockwise direction. Pinch roller 74 is rotated by drive roller 72 in a clockwise direction, as indicated. Gear 46 further drives gear 84 of third arm assembly 80, which in turn, drives gear 102 of platen driver 100 in a counterclockwise direction. The motion of gear 102 causes arm 104 and specifically, second cam follower 108 to move further in the second cam groove 98. At this point, platen 92 is disposed at its peak angle, approximately 85° from the horizontal. As platen 92 reaches its peak angle, fingers 93 are disposed at the rear of the slots formed in platen 92.

Figure 9:
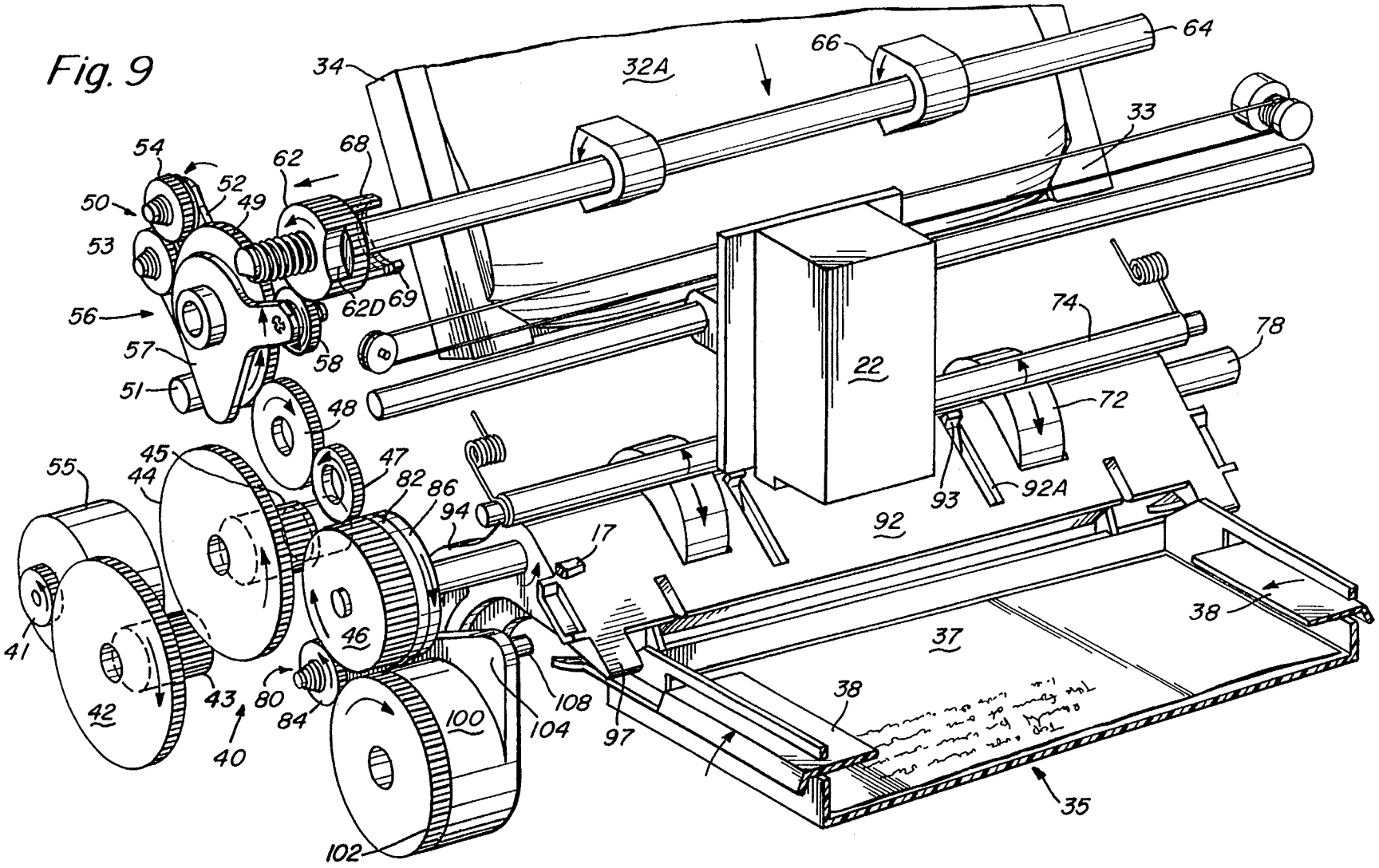

Referring to FIG. 9, drive motor 55 reverses directions, now rotating in a counterclockwise direction (all directions are as shown in FIG. 9). The motion of drive motor 55 is translated through gears 41–47 to gear 48. Gear 48 drives gear 49, causing gear 49, first arm assembly 50 and second arm assembly 56 to rotate in a counterclockwise direction about the axis of rotation of gear 49. The counterclockwise rotation of arm 52 causes gear 54 to disengage pick gear 62 while causing gear 58 to engage pick gear 62. Upon engaging pick gear 62, gear 58 is driven in a clockwise direction by gear 49. Gear 58, in turn, drives pick gear 62 in a counterclockwise direction, causing shoulder 68, which is integrally formed therewith, to be deflected by pick cam 69. Pick gear 62 rotates, pick roller 64 and D-shaped rollers 66 in a counterclockwise direction. As D-shaped rollers 66 rotate, their corregated surfaces frictionally engage the top sheet 32A of paper supply 32, forcing it against retainer lips 33 of supply tray 34. As D-shaped rollers 66 continue their counterclockwise motion, top sheet 32A buckles forcing its leading edge away from supply tray 34, releasing top sheet 32A from lips 33, as indicated in FIG. 9.

Gear 46 rotates clockwise direction, causing lost motion disk 86, drive roller axle 78 and drive rollers 72 to rotate in a clockwise direction. Gear 46 drives gear 84 of third arm assembly 80 causing platen gear 102 and arm 104 of platen driver 100 to also rotate in a clockwise direction. The rotation of arm 104 causes first cam follower 106 to enter first cam groove 96 and causes second cam follower 108 to leave second cam groove 98, pivoting platen 92 about drive roller axle 78 in a counterclockwise direction. As platen 92 pivots towards a horizontal orientation, tabs 97 disengage cam wings 39 causing wings 38 to return to their initial position, extending through the side walls of receiving tray 36.

Figure 10:
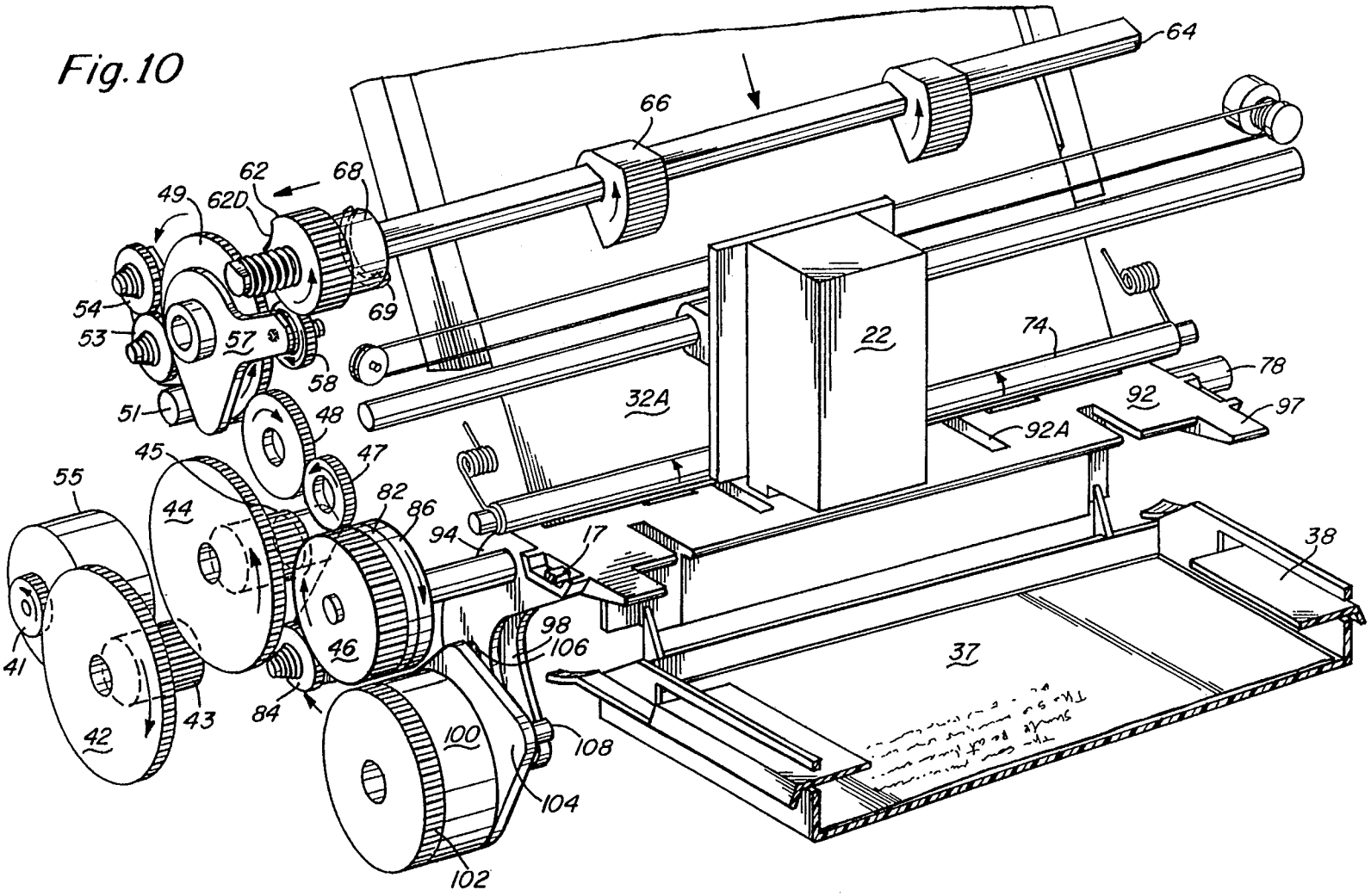

Referring to FIG. 10, drive motor 55 continues rotating in a counterclockwise direction (all directions are as shown in FIG. 10). Gear 48 continues to rotate in a clockwise direction, driving gear 49 in a counterclockwise direction and causing first arm assembly 50 to pivot in a counterclockwise direction until encountering stop 51 of frame wall 18. Gear 58 of second arm assembly 56 continues to drive pick gear 62 in a counterclockwise direction, causing shoulder 68 to be further deflected by pick cam 69. The deflection of shoulder 68 causes further axial displacement of pick gear 62 along pick roller 64. As pick gear 62 rotates in counterclockwise direction, D-shaped rollers 66 also rotate in a counterclockwise direction urging top sheet 32A out of supply tray 34 and into the nip formed between drive rollers 72 and pinch roller 74.

Gear 46, lost motion disk 86, drive roller axle 78 and drive rollers 72 continue to rotate in a clockwise direction, while pinch roller 74 rotates in a counterclockwise direction. As D-shaped rollers 66 advance sheet 32A, its leading edge is engaged by drive rollers 72 and pinch roller 74. The motion of rollers 72 and 74 advance the leading edge of sheet 32A preferably approximately seven millimeters beyond the nip line 75.

As platen 92 is pivoted towards a horizontal position, it encounters platen stop 17, which is integrally formed with frame wall 18, at which point platen 92 is generally horizontal in orientation, as shown in FIG. 10. The force exerted by the platen springs 95 is transferred by cam followers 106 and 108 and gear 102 to gear 84, causing gears 84 and 102 to remain engaged until platen 90 reaches stop 17, at which time the force from platen springs 95 is no longer transferred. Platen 92 returns to horizontal smoothly as gear 46 rotates clockwise. Third arm 82 also pivots clockwise so that gear 84 disengages platen gear 102. Third arm 82 pivots until hitting a stop (not shown) integrally formed with frame wall 18.

Figure 11:
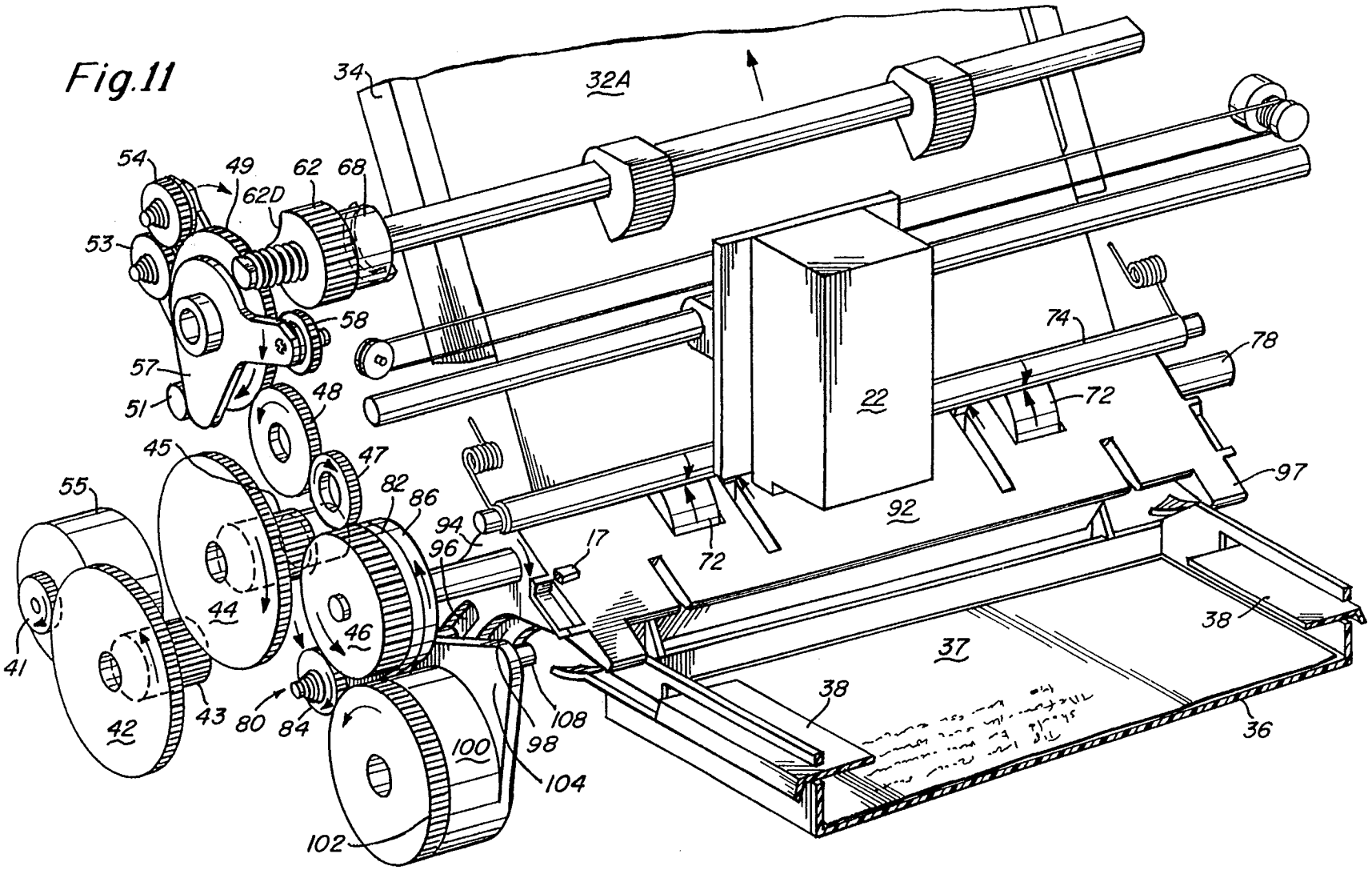

In accordance with the method of skew correction of the present invention, once a sheet of paper is advanced through the drive roller assembly, it is retracted so as to be disposed within the nip. Referring to FIG. 11, drive motor 55 reverses direction, now moving clockwise (all directions are as shown in FIG. 11). This motion is translated through gears 41–47, causing gear 48 to rotate in a counterclockwise direction, and drive gear 49 to rotate in a clockwise direction. The teeth of gear 53 are fixed within the teeth of gear 49 causing arm 52 of arm assembly 50 to pivot in a clockwise direction about the axis of rotation of gear 49. The clockwise rotation of gear 49 causes arm 57 to pivot in a clockwise direction until encountering stop 51. As arm 57 pivots gear 58 disengages pick gear 62. The disengagement of pick gear 62 causes pick roller 64 and D-shaped rollers 66 to remain stationary, with the corrugated surfaces of rollers 66 facing away from paper supply 32.

The clockwise motion of drive motor 55 is translated through gears 41–46 to gear 84, which in turn drives gear 102, arm 104 in a counterclockwise direction. As arm 104 pivots in a counterclockwise direction, first cam follower 106 begins to withdraw from first cam groove 96 while second cam follower 108 begins to engage second cam groove 98. The interaction of the first and second cam followers with the two-stage cam 94 causes platen 92 to pivot in a clockwise direction continuously.

When platen 92 is disposed at approximately 25° with respect to horizontal, the pins 46B protruding from gear 46 into the elongated slots 86A of lost motion disk 86 engage the disk, rotating it in a counterclockwise direction. The rotation of lost motion disk 86 causes drive roller axle 78 and drive rollers 72 to rotate in a counterclockwise direction, which in turn cause pinch roller 74 to rotate in a clockwise direction. The combined motions of pinch roller 74 and drive rollers 72 cause top sheet 32A to move backward and upward through nip 75 and disengage rollers 72 and 74. Once the entire leading edge of top sheet 32A is free of pinch roller 74, the force of gravity on the mass of the sheet, i.e. its weight, forces the leading edge of sheet 32A to remain in the nip, as shown in FIG. 2. If sheet 32A had been initially skewed upon entering the nip in a forward direction, as soon as it is reversed through the nip, the angle of the sheet, in conjunction with its weight force the leading edge to settle into the nip so that it is parallel thereto as shown in FIG. 3.

Figure 12:
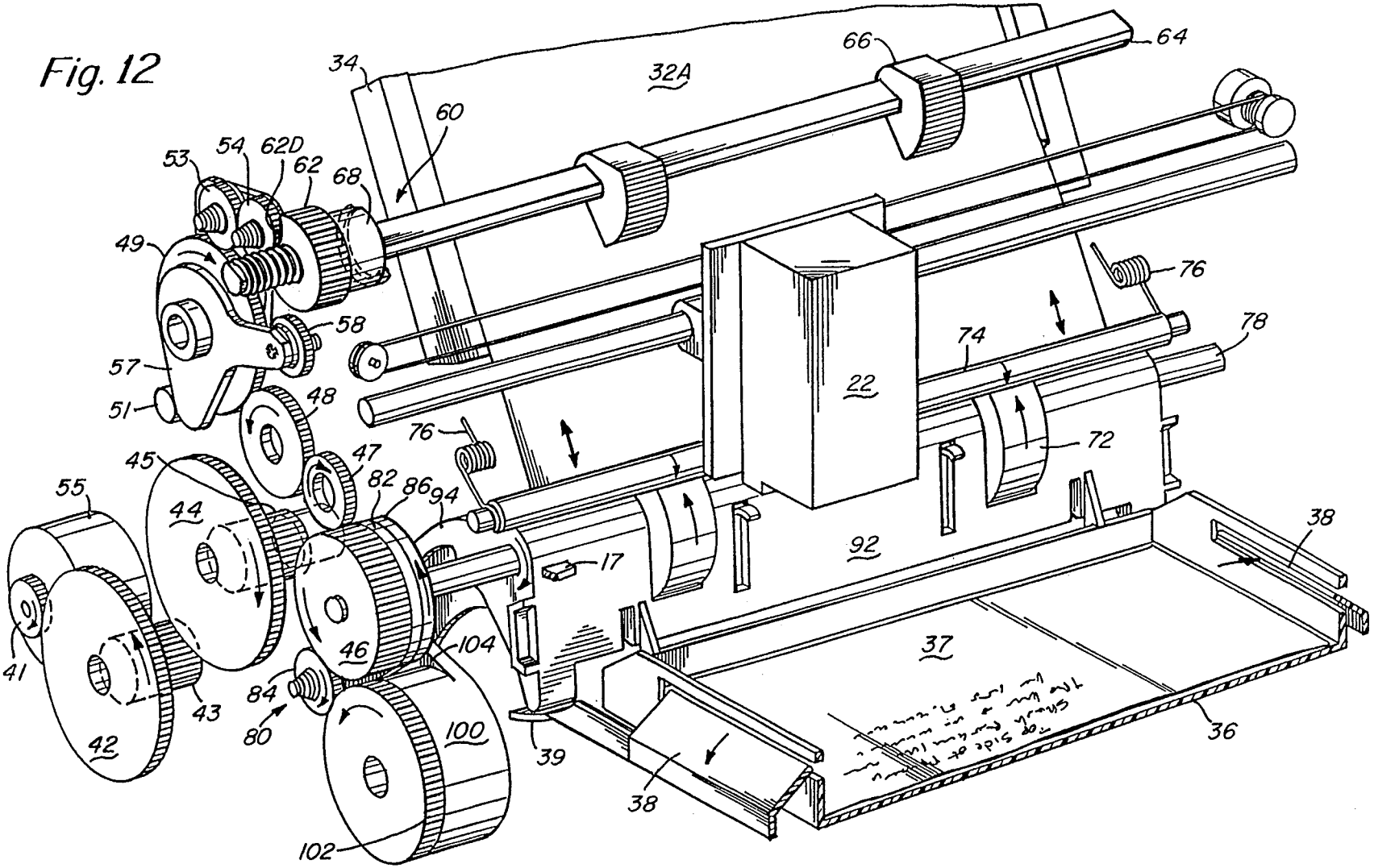

With the leading edge of top sheet 32A is situated within nip 75, as shown in FIG. 2, drive motor 55 continues to rotate in a clockwise direction (all directions are as shown in FIG. 12). Gear 46, lost motion disk 86, drive roller axle 78 and drive rollers 72 continue to rotate in a counterclockwise direction, while pinch roller 74 continues to rotate in a clockwise direction. This "backwards running" of rollers 72 and 74 allow top sheet 32A to jiggle out of nip 75 or do a "gravity dance", allowing the leading edge of sheet 32A to overcome the frictional engagement of rollers 72 and 74 and to settle parallel into nip 72 solely because of the force of its own weight. Drive rollers 72 and pinch roller 74 are rotated in reverse for a short period of time, for example one second, to provide the minimum time necessary for the leading edge of top sheet 32A to settle parallel to nip 75. It will be obvious to those reasonably skilled in the art that the duration of the "gravity dance" or the length of time in which the rollers are run in reverse should be long enough to guarantee that the leading edge of top sheet 32A is completely released from rollers 72 and 74, regardless of the amount of skew and the extent to which the leading edge was advanced beyond the nip. During this gravity dance it is important that sheet 32A be free of any side forces which may discourage it from settling parallel with nip 75.

Following the gravity dance, top sheet 32A, assumes the position indicated by the solid lines in FIG. 3, in which its leading edge is shown substantially parallel with nip 75 formed between drive roller 72 and pinch roller 74. With the leading edge of top sheet 32A now parallel with nip 75, the sheet may again be advanced through the nip and into the printing zone. To align the print heads 22A of printing assembly 20 with the same location on each sheet of paper, thereby insuring a uniform top margin or "top-of-form", the paper control apparatus 15 need only advance the leading edge of top sheet 32A a predetermined distance into the print zone. This distance may be programmed into microprocessor 130 according to the printing format desired. Accordingly, the need for special detecting switches, used in prior art printers to locate the leading edge for "top-of-form" alignment is eliminated.

Figure 13:
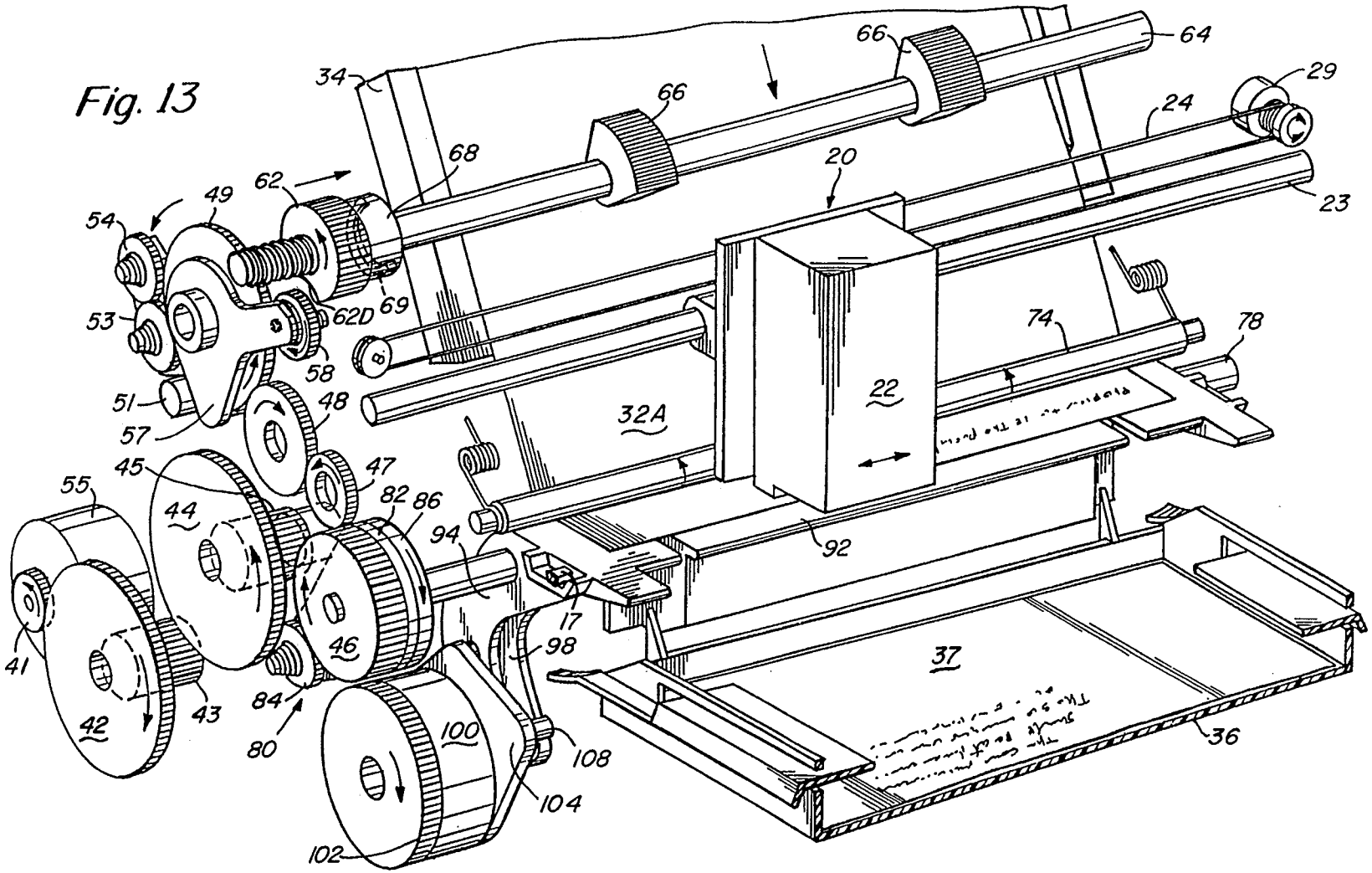
FIGS. 13–14 are sequential perspective views of FIG. 4 illustrating chronologically the positions of the components of the paper control and skew correction apparatus during the print mode.

Referring to FIG. 13, drive motor 55 reverses directions, now rotating in a counterclockwise direction (all directions are as shown in FIG. 13). The rotation of drive motor 55 is translated to first arm assembly 50 and second arm assembly 56, through transmission gears 41–49, causing both arm assemblies to rotate in a counterclockwise direction. Gear 49 drives gear 58 in a clockwise direction, which in turn, drives pick gear 62 and pick assembly 60 in a counterclockwise direction. Pick cam 69 continues to deflect shoulder 68 and pick gear 62 axially along pick roller 64 until the teeth of gear 58 are adjacent dish out section 62D of gear 62. At this point, shoulder 68 slides off pick cam 69 under the force of the spring 67 and is disposed adjacent frame wall 18. With the sliding movement of pick gear 62 against frame wall 18, the teeth of gear 58 disengage pick gear 62 and slide into dish out section 62D of pick gear 62. Pick gear 62 is now in the "home" position in which pick roller 64 is stationary and gear 58 is effectively disengaged, with further rotation thereof not effecting pick gear 62.

The counterclockwise rotation of drive motor 55 is translated through gears 41–46 to gear 84 which is rotated in a counterclockwise direction. Gear 84 in turn allows the platen gear 102 to rotate in a clockwise direction. Arm 104 rotates in unison with platen gear 102 so that first cam follower 106 enters first cam groove 96 while second cam follower 108 exits from second cam groove 98. The interaction of the first and second cam followers with the first and second cam grooves, respectively causes a pivoting of two-stage cam 94 and platen 92 in a counterclockwise direction, toward a horizontal position. When platen 92 is disposed at approximately a 15° with respect to horizontal (not shown), the cylindrical pins of gear 46 engage lost motion disk 86, driving disk 86 in a clockwise direction. The rotation of disk 86, in turn, causes a rotation of drive roller axle 78 and drive rollers 72 in a clockwise direction. The clockwise rotation of rollers 72 cause a counterclockwise rotation of pinch roller 74. The combined action of roller 72 and 74 on the leading edge of top sheet 32A advances the sheet beyond the nip through the rollers, and toward the print zone.

As drive motor 55 continues to rotate in a counterclockwise direction, platen driver 100 continues to pivot platen 92 in a counterclockwise direction until it engages platen stops 17 of frame wall 18, indicating that a horizontal position has been reached. The motion of drive motor 55 continues to be translated through gears 41–48 to gear 49 which is driven in a counterclockwise direction. The motion of gear 49 causes a counterclockwise pivoting of first arm assembly 50 until it encounters stop 51 of frame wall 18. Gear 49 continues to drive gear 58 of second arm assembly 56 in a clockwise direction. The rotation of the gear 58 has no effect on pick gear 62, with pick assembly 60 remaining inactive for the remainder of the printing process.

Gear 46 continues to rotate in a clockwise direction causing lost motion disk 86, drive roller axle 78, and print rollers 72 to rotate in a clockwise direction, which causes pinch roller 74 to rotate in a counterclockwise direction. The combined action of roller 72 and 74 continues to advance the leading edge of top sheet 32A over platen 92 and into the print zone, at approximately 16 millimeters past nip 75. Once top sheet 32A has entered the print zone, printhead carriage 22 of print assembly 20, under microprocessor control, travels back and forth on carriage rod 23 through the printing zone depositing ink onto top sheet 32A. The horizontal angle of platen 92 facilitates bending of sheet 32A and maintains proper head-to-paper spacing by keeping the sheet flat as it is advanced through the print zone by the motion of drive rollers 72 and pinch roller 74, as shown in FIG. 13.

As top sheet 32A is advanced over platen 92 and through the print zone, its leading edge falls off platen 92 and onto wings 38 of receiving assembly 35. Wings 38 prevent sheet 32A from smearing the ink on the most recently printed sheet disposed in receiving tray 36. Paper control apparatus 15 maintains its current status during the printing process until the trailing edge of top sheet 32A enters the print zone.

Figure 14:
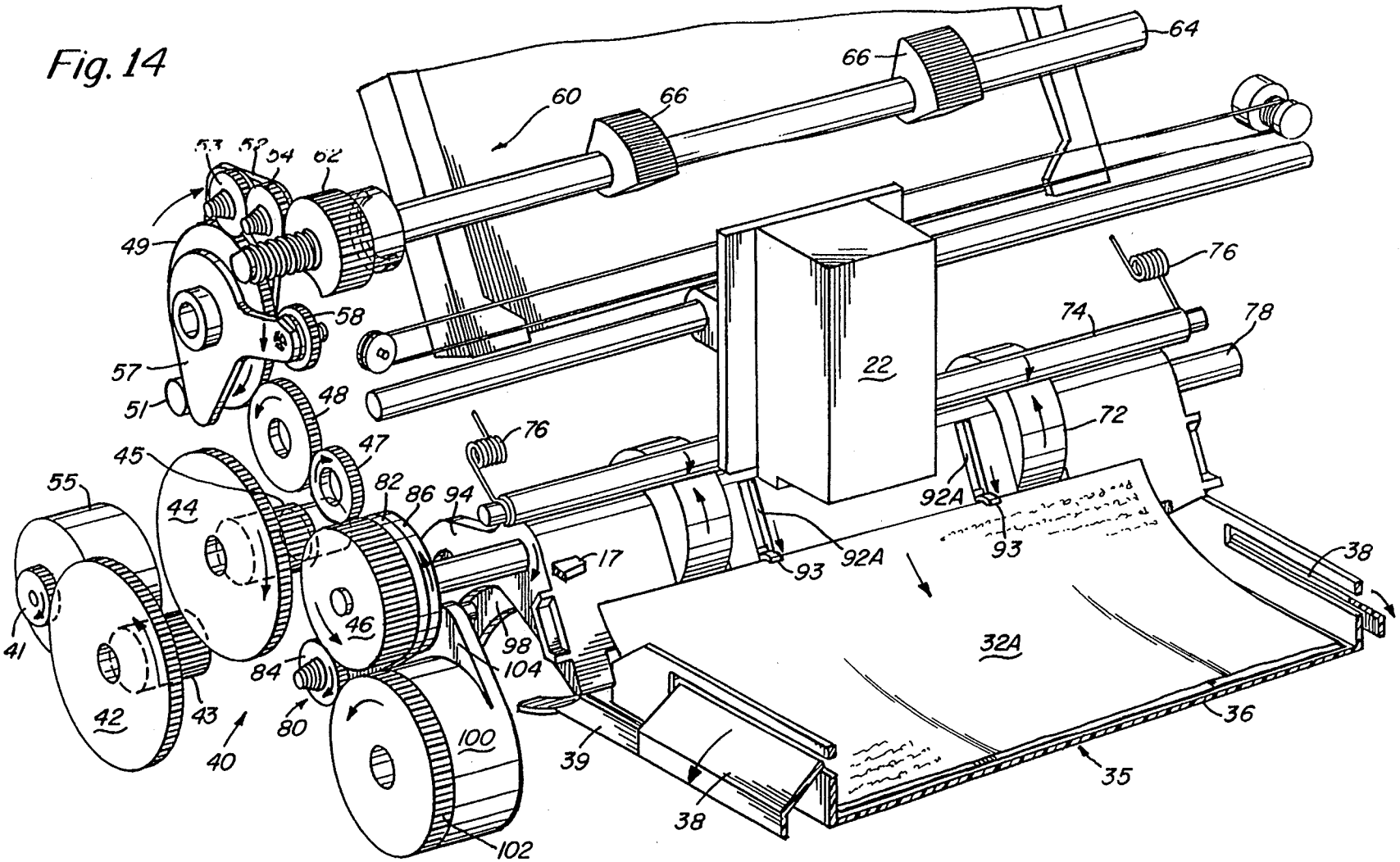

Referring to FIG. 14, drive motor 55 reverses and moves in a clockwise direction (all directions are as shown in FIG. 14). The motion of drive motor 55 is translated through gears 41–48 causing gear 49 to rotate in a clockwise direction which, in turn, causes first arm assembly 50 to pivot in a clockwise direction so that gear 54 nearly engages pick gear 62, while second arm assembly 56 pivots in a clockwise direction and encounters stop 51 of frame wall 18. The rotary motion of drive motor 55 is translated to gear 46 through gears 41–45 causing gear 46 to rotate in a counterclockwise direction. The motion of gear 46 causes lost motion disk 86, drive roller axle 78, and drive roller 72 to also rotate in a counterclockwise direction. The motion of drive roller 72 causes pinch roller 74 to rotate in a clockwise direction.

Gear 46 drives gear 84 of third arm assembly 80, which in turn drives gear 102 of platen driver 100. Arm 104 of platen driver 100 rotates in a counterclockwise direction causing cam followers 106 and 108 to engage cam grooves 96 and 98, respectively causing a pivoting of platen 92 in a clockwise direction, as indicated. Platen 92 continues to pivot about drive roller axle 78 in a clockwise direction, causing fingers 93 to project outward though slots 92A and engage the trailing edge of top sheet 32A, urging sheet 32A from platen 92 and into receiving tray 36. When platen 92 is approximately 15° above vertical, gear 46 engages lost motion disk 86, as previously described, rotating lost motion disk 86, drive roller axle 78, and drive rollers 72 in a counterclockwise direction. The motion of drive rollers 72 rotate pinch roller 74 in a clockwise direction.

As platen 92 attains a position of approximately 60° with respect to horizontal, tabs 97 deflect cam wings 39, causing wing 38 to be pivotally retracted from the side walls of receiving tray 36. As wings 38 retract, top sheet 32A falls into receiving tray 36.

The complete cycle of picking a sheet of paper, feeding it to paper control and skew correction assembly 15, correcting the skew and printing the paper is complete. Paper control apparatus 15 next returns to the state described with regard to the pause mode, as illustrated in FIG. 4, awaiting operation on the next sheet of paper.

In the method and apparatus of the present invention a single drive motor is utilized to correct the skew of a sheet of paper during the feed process and control the paper during the printing process.

In view of the above description, it is likely that modifications and improvements will occur to those skilled in the art which are within the scope of this invention. The above description is intended to be exemplary only the scope of the invention being defined by the following claims and their equivalents.

What is claimed is:

1. A method for controlling the skew between the leading edge of a sheet of paper and the print contained thereon in a printer mechanism having a roller assembly with at least two rollers forming a nip therebetween, the nip being parallel with the print, the sheet of paper also having a trailing edge, said method comprising the steps of:

advancing a sheet of paper into the roller assembly so that the leading edge of the sheet is disposed beyond the nip;

retracting the sheet of paper from the roller assembly with the leading edge retained in the nip;

during said retracting step, applying a drag force to a generally flat surface of the sheet of paper while allowing the entire sheet of paper from the leading edge to the trailing edge continuing retracting the sheet of paper from the roller assembly without buckling of the sheet of paper so that the frictional engagement of the leading edge by the roller assembly is overcome by the gravitational and drag forces on the paper, allowing the leading edge to settle within the nip and parallel thereto; and readvancing the sheet of paper into the roller assembly with the leading edge parallel to the nip as the paper is advanced through the nip.

2. The method of claim 1 wherein the step of advancing the sheet of paper comprises actuating the roller assembly so that the roller assembly engages and urges the sheet of paper in a forward direction.

3. The method of claim 1 wherein the step of retracting the sheet of paper comprises the steps of actuating the roller assembly so that roller assembly urges the sheet of paper in a rearward direction, causing the leading edge to disengage from the roller assembly; and supporting the sheet of paper at an acute angle with respect to a horizontal surface.

4. The method of claim 1 wherein the step of continuing retracting the sheet of paper comprises actuating the roller assembly to urge the leading edge in a rearward direction, following disengagement from the roller assembly.

5. The method of claim 1 wherein the step of readvancing the sheet of paper comprises actuating the roller assembly so that the roller assembly engages and urges the sheet of paper in a forward direction.

6. The method of claim 1 further comprising the step of supplying the sheet of paper to the roller assembly prior to the step of advancing the paper into the roller assembly.

7. The method of claim 1 further comprising the step of depositing print on the sheet of paper subsequent to the step of readvancing the sheet of paper.

8. Apparatus for controlling the skew between a sheet of paper having a leading edge and a trailing edge and the print contained thereon in a printer mechanism, said apparatus comprising:

a roller assembly having a drive roller and a pinch roller disposed parallel with and adjacent to one another to form a nip therebetween;

apparatus for supplying individual sheets of paper to the roller assembly;

a drive motor coupled to the roller assembly for actuating the roller assembly and for operatively advancing and retracting a sheet of paper through the nip of the roller assembly; and apparatus for applying a drag force to a sheet of paper when a sheet paper is being retracted from said roller assembly away from said nip and toward said supplying means, said drag force applying apparatus permitting the entire sheet of paper from the leading edge to the trailing edge to move with respect thereto when the sheet of paper is being retracted to prevent buckling of the sheet of paper.

9. Apparatus as recited in claim 8 wherein said drag force applying apparatus includes a mechanism for applying a frictional force to a generally flat surface of the sheet of paper as the generally flat surface of the sheet of paper moves past said drag force applying apparatus.

10. Apparatus as recited in claim 9 wherein said drag force applying apparatus includes a plurality of flexible fingers which are disposed at an acute angle with respect to a sheet of paper and which point toward said nip, said fingers being deflected away from said nip when a sheet of paper is retracted away from said nip toward said supplying apparatus due to the frictional interaction between said fingers and the sheet of paper.

11. Apparatus as recited in claim 8 wherein said drag force applying apparatus comprises a roller rotatably mounted on an axle, said roller being urged into contact with a sheet of paper.

12. Apparatus for controlling the skew between a sheet of paper and the print contained thereon in a printer mechanism comprising:

a roller assembly having a drive roller and a pinch roller disposed parallel with and adjacent to one another to form a nip therebetween;

apparatus for supplying individual sheets of paper to the roller assembly;

a drive motor coupled to the roller assembly for actuating the roller assembly and for operatively advancing and retracting a sheet of paper through the nip of the roller assembly; and at least one depending finger which forms an acute angle with respect to the sheet of paper and which is in frictional contact with the sheet of paper for applying a drag force to the sheet of paper when the sheet of paper is being retracted from said roller assembly away from said nip and toward said supply apparatus.

13. Apparatus as recited in claim 12 further comprising:

a support rod; and a plate pivotally mounted to said support rod, said depending finger being supported by said plate.

14. Apparatus as recited in claim 12 wherein said depending finger forms an acute angle with respect to a vertical direction and is held against a sheet of paper by gravity.

15. Apparatus as recited in claim 12 wherein said finger is generally oriented in a vertical direction and is positioned so that only a tip thereof frictionally engages a sheet of paper.

16. Apparatus as recited in claim 15 wherein when a sheet of paper is retracted from said nip toward said supplying apparatus, frictional interaction between said finger and the sheet of paper causes said finger to deflect away from said nip.

17. Apparatus for controlling the skew between a sheet of paper and the print contained thereon in a printer mechanism comprising:

a roller assembly having a drive roller and a pinch roller disposed parallel with and adjacent to one another to form a nip therebetween;

apparatus for supplying individual sheets of paper to the roller assembly;

a drive motor coupled to the roller assembly for actuating the roller assembly and for operatively advancing and retracting a sheet of paper through the nip of the roller assembly; and an eccentrically mounted cam whose outer surface is in frictional contact with the sheet of paper for applying a drag force to the sheet of paper when the sheet of paper is being retracted from said roller assembly away from said nip and toward said supplying apparatus.

18. Apparatus as recited in claim 17 further comprising a stop limiting the extent to which said cam pivots toward a sheet of paper.

19. Apparatus for controlling the skew between a sheet of paper and the print contained thereon in a printer mechanism comprising:

a roller assembly having a drive roller and a pinch roller disposed parallel with and adjacent to one another to form a nip therebetween;

apparatus for supplying individual sheets of paper to the roller assembly;

a drive motor coupled to the roller assembly for actuating the roller assembly and for operatively advancing and retracting a sheet paper through the nip of the roller assembly; and apparatus for applying a drag force to a sheet of paper when a sheet paper is being retracted from said roller assembly away from said nip and toward said supply apparatus, said drag force applying apparatus comprising a roller rotatably mounted on an axle and being urged into contact with a sheet of paper, said roller comprising a one-way clutch permitting free rotation of said roller when paper is advanced toward said nip, and preventing free rotation of said roller when paper is retracted away from said nip toward said supplying apparatus.

* * * * *